US007275746B2

(12) United States Patent
Jensen

(10) Patent No.: US 7,275,746 B2
(45) Date of Patent: Oct. 2, 2007

(54) CROSSWORD PUZZLE BOARD GAME

(76) Inventor: Richard L. Jensen, N7202 Division Ave., Spencer, WI (US) 54479

( * ) Notice: Subject to any disclaimer, the term of this patent is extended or adjusted under 35 U.S.C. 154(b) by 97 days.

(21) Appl. No.: 11/174,626

(22) Filed: Jul. 6, 2005

(65) Prior Publication Data

US 2006/0022407 A1 Feb. 2, 2006

Related U.S. Application Data

(60) Provisional application No. 60/592,219, filed on Jul. 30, 2004.

(51) Int. Cl.
*A63F 3/00* (2006.01)

(52) U.S. Cl. ..... 273/272; 273/153 R; 463/9

(58) Field of Classification Search ..... 273/153 R, 273/272; 463/9

See application file for complete search history.

(56) References Cited

U.S. PATENT DOCUMENTS

| | | | |
|---|---|---|---|
| 2,055,159 | A | 9/1936 | Scofield |
| 3,174,753 | A | 3/1965 | Miller |
| 4,171,815 | A | 10/1979 | Sturtz |
| 4,179,126 | A | 12/1979 | Coefield |
| 4,209,173 | A | 6/1980 | Curtis et al. |
| 4,244,580 | A | 1/1981 | Hoyles |
| 4,299,578 | A | 11/1981 | Wayman |
| 4,306,724 | A | 12/1981 | Brzezinski et al. |
| 4,625,971 | A | 12/1986 | Ferguson |
| 4,850,595 | A | 7/1989 | Sherman et al. |
| 4,907,807 | A | 3/1990 | Lee et al. |
| 5,230,515 | A | 7/1993 | Cohen |
| 5,395,118 | A | 3/1995 | Barrett |
| 5,429,371 | A | 7/1995 | Bledsoe |
| 5,566,942 | A | 10/1996 | Elum |
| 6,340,159 | B1 | 1/2002 | Giangrante |
| 6,378,867 | B1 | 4/2002 | Shalless |
| 6,460,854 | B1 | 10/2002 | McCarey |
| 6,491,300 | B2 | 12/2002 | Harris et al. |
| 2002/0063386 | A1 | 5/2002 | Harris et al. |

FOREIGN PATENT DOCUMENTS

| | | |
|---|---|---|
| GB | 2193898 | 2/1988 |
| GB | 2356153 | 5/2001 |

*Primary Examiner*—Vishu K. Mendiratta
(74) *Attorney, Agent, or Firm*—Richard C. Litman

(57) ABSTRACT

The crossword puzzle board game provides for competitive play in the solving of a crossword puzzle by two or more players. Players attempt to solve the puzzle by solving selectively revealed clues determined by a row or column determination die and selection of a row or column selection card. An answer is verified by removing concealing markers previously placed over the solution on a puzzle sheet. Alternatively, the solutions may be optically concealed, with a special viewer allowing them to be viewed. Points are distributed for correct answers according to the order in which the clues are solved; points are deducted for incorrect or misspelled answers. A player may attempt to solve one clue, or to "SNEAK A PEEK" under one marker and receive zero points at his or her turn. The game ends when all clues are answered; stalemates are not possible. The highest scoring player wins the game.

20 Claims, 16 Drawing Sheets

CROSSWORD PUZZLE BOARD GAME

CROSS-REFERENCE TO RELATED APPLICATION

This application claims the benefit of U.S. Provisional Patent Application Ser. No. 60/592,219, filed Jul. 30, 2004.

BACKGROUND OF THE INVENTION

1. Field of the Invention

The present invention relates to games, and more particularly to various embodiments of a competitive board game for multiple players that requires players to solve a crossword puzzle.

2. Description of the Related Art

Crossword puzzles are among the most popular word games generally played alone by an individual. In addition, many derivations of the crossword puzzle or other word games have been developed to accommodate multiple players. Some of these games require players to obtain letter markers as a prerequisite before solving a clue. Letters must be obtained by traveling along paths using playing pieces or by answering questions prior to acquiring the playing pieces. Points are generally awarded based on a value designated for the letter or the locations of such letters on a game board. At times, games end prematurely because a stalemate is reached due to difficulty in answering clues or when all letter markers have been used, e.g., Scrabble®. Many of these games do not provide a means by which a stalemate is thwarted so that the game can be finished, for example, by revealing certain letters. Also, some games based on crossword puzzles display all the clues for the puzzle to all players, making it difficult for players of different skill levels to have an equal chance at solving clues to the puzzle. When all clues are displayed at once, rather than being selectively displayed, players are prevented from strategically solving clues on the crossword puzzle to obtain the highest points possible for solving the clues.

A crossword puzzle game is therefore desired that can be played by individuals having varying skill levels, with the game always being solved based on hints obtained progressively throughout the game, and wherein clues are selectively revealed to individual players, thereby allowing the players to strategically solve individual words based on the prospect of obtaining the highest possible point value for the word being solved.

A discussion of the related art of which the present inventor is aware, and its differences and distinctions from the present invention, is provided below.

U.S. Pat. No. 2,055,159, issued to Scofield on Sep. 22, 1936, describes a game apparatus based on a crossword puzzle. The game has sets of colored letter-bearing blocks that will be used by players to construct words. The person with the greatest number of correct words or colored blocks at the end wins.

U.S. Pat. No. 3,174,753, issued to Miller on Mar. 23, 1965, describes a crossword puzzle. The puzzle comprises a pegboard that requires letter pieces to be inserted into the peg holes of the pegboard and arranged on the board to solve the puzzle. The letter pieces may have irregular shapes creating an extra hurdle that must be overcome before solving the puzzle. All clues are disclosed on the game board to all players.

U.S. Pat. No. 4,171,815, issued to Sturtz on Oct. 23, 1979, describes a word-forming game. The game comprises a framed game board for holding a puzzle insert, clues associated with the puzzle, and lettered tiles for placement on the framed game board. There are 169 square spaces and 168 lettered tiles containing various numbers of individual letters. The first player to start the game is determined by drawing tiles and determining who has the closest letter tile to the letter "A".

U.S. Pat. No. 4,179,126, issued to Coefield on Dec. 18, 1979, describes a crossword puzzle game. The game uses colored pencils for different players to write down answers and a timer to allot time within which clues must be solved. The solution to the puzzle is printed on the back of each puzzle. Points are assigned to each square in the crossword puzzle and are calculated at the end of the game based on color. Rules require players to answer one clue at a time with provisions being in place to allow players to complete the entire game or fill in uncompleted words during a players turn. The clues associated with the puzzle are displayed simultaneously to all the players.

U.S. Pat. No. 4,209,173, issued to Curtis et al. on Jun. 24, 1980, describes crossword puzzle game equipment. The equipment comprises a blank game board, a clue book and a puzzle pattern. The puzzle can be slid into the game board and the clue book corresponds to the spaces on the puzzle pattern. The clue book displays the entire set of clues for the game during the play session. The game can be played competitively by many people at one time by preparing and using several puzzle patterns at a single time.

U.S. Pat. No. 4,299,578, issued to Wayman on Nov. 10, 1981, describes a crossword system and game apparatus. The system is use to create crossword puzzles. The game has a flat game board having a 15 by 15 grid, three classes of tiles marked with letters and possessing magnets to facilitate the movement of the tiles on the board. Individual spaces on the game board are designated as "V", vowel, or "C" for consonant whereby only letter tiles being either a vowel or consonant will be placed within designed individual spaces.

U.S. Pat. No. 4,306,724, issued to Brzezinski et al. on Dec. 22, 1981, describes a board game apparatus. The games uses a board having an inner area made up of a grid used to form words from letter pieces and an outer area made up of a travel path used to accommodate movement of player pieces along a predetermined path, play money to record score, dice to control movement of player's and cards to record penalty and decide categories. The travel path has indicia that direct movement of play pieces and word-forming operations on the inner area.

U.S. Pat. No. 4,625,971, issued to Ferguson on Dec. 2, 1986, describes a crossword puzzle educational game. The game has a play surface comprising a plurality of segments of equal dimension surrounding a central segment used to create a large number of possible playing configurations. The play surface has a plurality of zones designating scoring areas thereby by providing incentive for players to fill in certain areas of the playing surface over other areas.

U.S. Pat. No. 4,850,595, issued to Sherman et al. on Jul. 25, 1989, describes a crossword puzzle game. The game comprises a game board, a puzzle sheet, a die and marking instruments. The die is used to determine the length of words that can be solved by the player and incorporated into the puzzle sheet upon one turn.

U.S. Pat. No. 4,907,807, issued to Lee et al. on Mar. 13, 1990, describes a board game for playing crossword puzzles. The game uses play pieces to travel around two continuous bands of squares around the periphery of the game board as controlled by dice and play cards. The game requires a pair of dice to be rolled to allow the play to land on a square that determine location, either across or down, and a number which specifies degree of difficulty and a number of a the clue that should be played from the play card. Then the player must correctly answer one of four clues displayed on a card in order to have the opportunity to place a word on the crossword puzzle and gain points.

U.S. Pat. No. 5,230,515, issued to Cohen on Jul. 27, 1993, describes a word-forming board game. The game uses playing pieces that are prescribed specific movement patterns, to travel along a board displaying letters and obtain the letters. The letters are ultimately used to form words. Points are awarded for each letter used in the formation of the word.

U.S. Pat. No. 5,395,118, issued to Barrett on Mar. 7, 1995, describes a crossword game board apparatus. The game board has two adjacent grids designated for use by individual teams. The teams start words using lettered markers in their designated grids. Each word must be at least five letters long and conjoin with another word on the board. Points are designated on each letter marker and can be doubled based on location on the game board. Letter markers can be traded if at least a five letter word cannot be constructed or upon the request of a low scoring opposing team.

U.S. Pat. No. 5,429,371, issued on Jul. 4, 1995 to Bledsoe, describes a word-based board game. The game has two play areas. The first area is a continuous path along the perimeter of the game board and the second area is a grid used to form words. The game uses play pieces that are controlled by the roll of a die. The play pieces move along the path of the first area to determine which letters to use to form words within the second area. Words can be spelled forward, backward, diagonally, vertically or horizontally.

U.S. Pat. No. 6,460,854, issued on Oct. 8, 2002 to McCarey, describes a puzzle-type game. The game uses a grid game board that is divided into four regions. Each region is designated for a particular player. Players enter words on their grids based on clues using only letter cubes disposed within their grid. When one player cannot make any further moves within their own grid they may complete entries in enemy zones. The game ends when no more entries can be made.

U.S. Pat. No. 6,491,300, issued on Dec. 10, 2002 to Harris et al., describes a board game. The game comprises a game board, letters disposed on the game board, play tokens used to move around on the game board, question cards divided by categories and game cards. Players roll the die to move the play tokens on the game board and land on a letter. The letter must be acquired to form words on the game cards, but the letters can only be won after correctly answering clues from the question cards.

U.S. Patent Publication No. 2002/0063386, published on May 30, 2002 to Harris et al., is the provisional application filing of the '300 U.S. Patent to the same patentees. The same points noted in the discussion of the '300 U.S. Patent are seen to apply here.

British Patent No. 2,193,898, published on Feb. 24, 1988, describes a board game that has a game board displaying a crossword grid. The grid is filled in with words formed by letter-bricks after answering individual clues carried on a clue card.

Finally, British Patent No. 2,356,153, published on May 16, 2001 to McCarey is the based upon the '854 U.S. Patent to the same patentee, described further above. The same points noted in the discussion of the '854 U.S. Patent are seen to apply here.

None of the above inventions and patents, taken either singly or in combination, is seen to describe the instant invention as claimed. Thus, a crossword puzzle board game solving the aforementioned problems is desired.

SUMMARY OF THE INVENTION

The crossword puzzle board game includes a game board, a solved crossword puzzle displaying numbered columns and rows, markers disposed over the solution on the solved puzzle to conceal the solution until needed, a specially marked cubical die for selecting horizontal or vertical play, a plurality of row and column number selection cards, clues and personal solving sheets. Players attempt to solve the puzzle by answering clues that are selectively revealed based on the selection of one card and the roll of the die. An answer is verified by removing the markers disposed over the answer on the puzzle. Alternatively, a clue sleeve may be provided which contains both the clues and answers. The answers are selectively viewable as required during the course of the game. An optical system may also be provided for the selective viewing of clues on a board.

Points are distributed for correct answers according to the order in which the clues are solved. Only one clue problem may be solved on each player turn. Alternatively, a "SNEAK A PEEK" may be provided to a player having an unsuccessful turn, wherein the player receives zero points but gains some knowledge of the puzzle. The game ends when all positions on the puzzle have been solved; the game never ends in a stalemate. The winner is determined as the person having the highest score.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
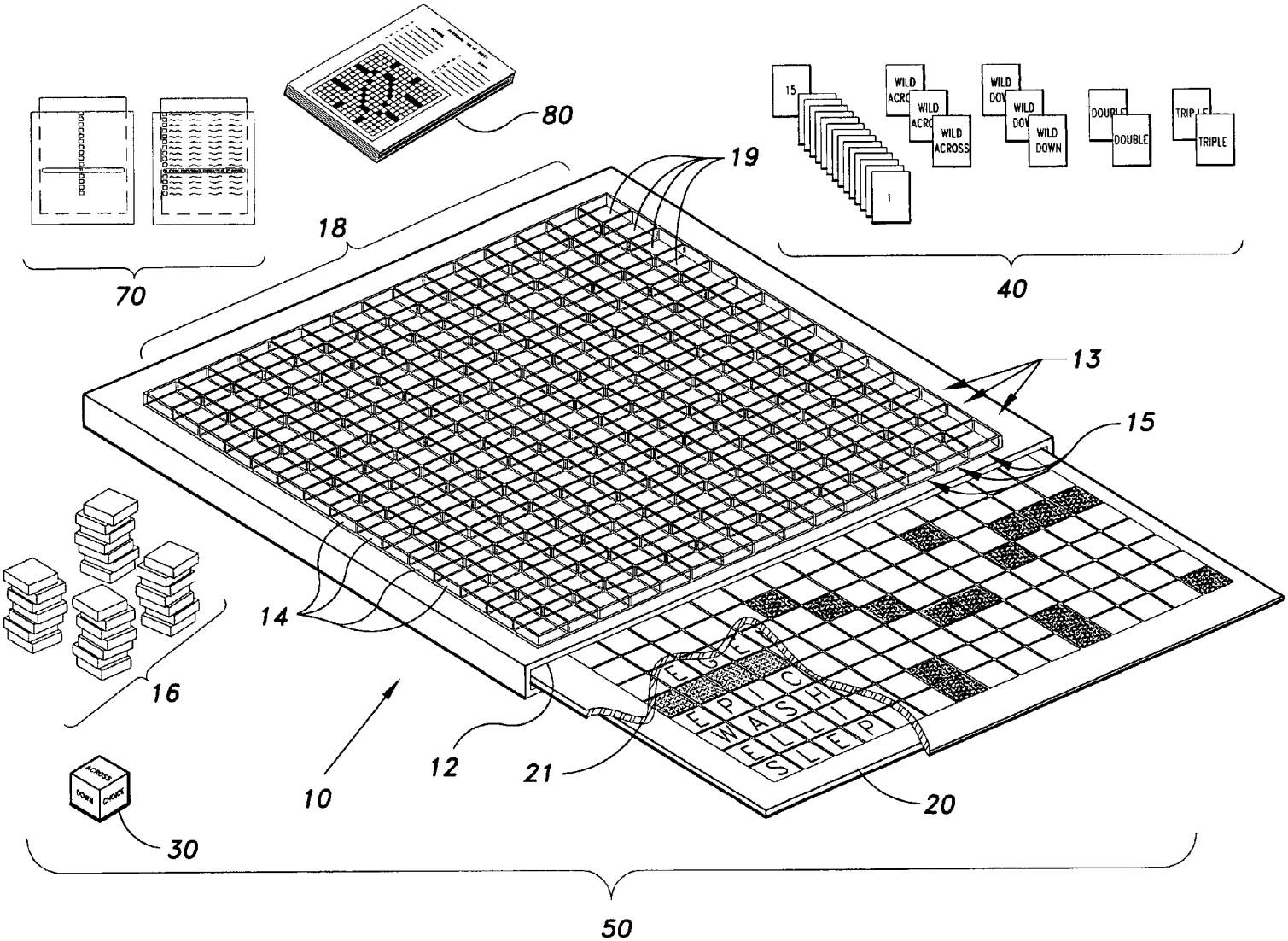
FIG. 1 is a perspective view of a crossword puzzle board game apparatus according to the present invention.
Figure 2:
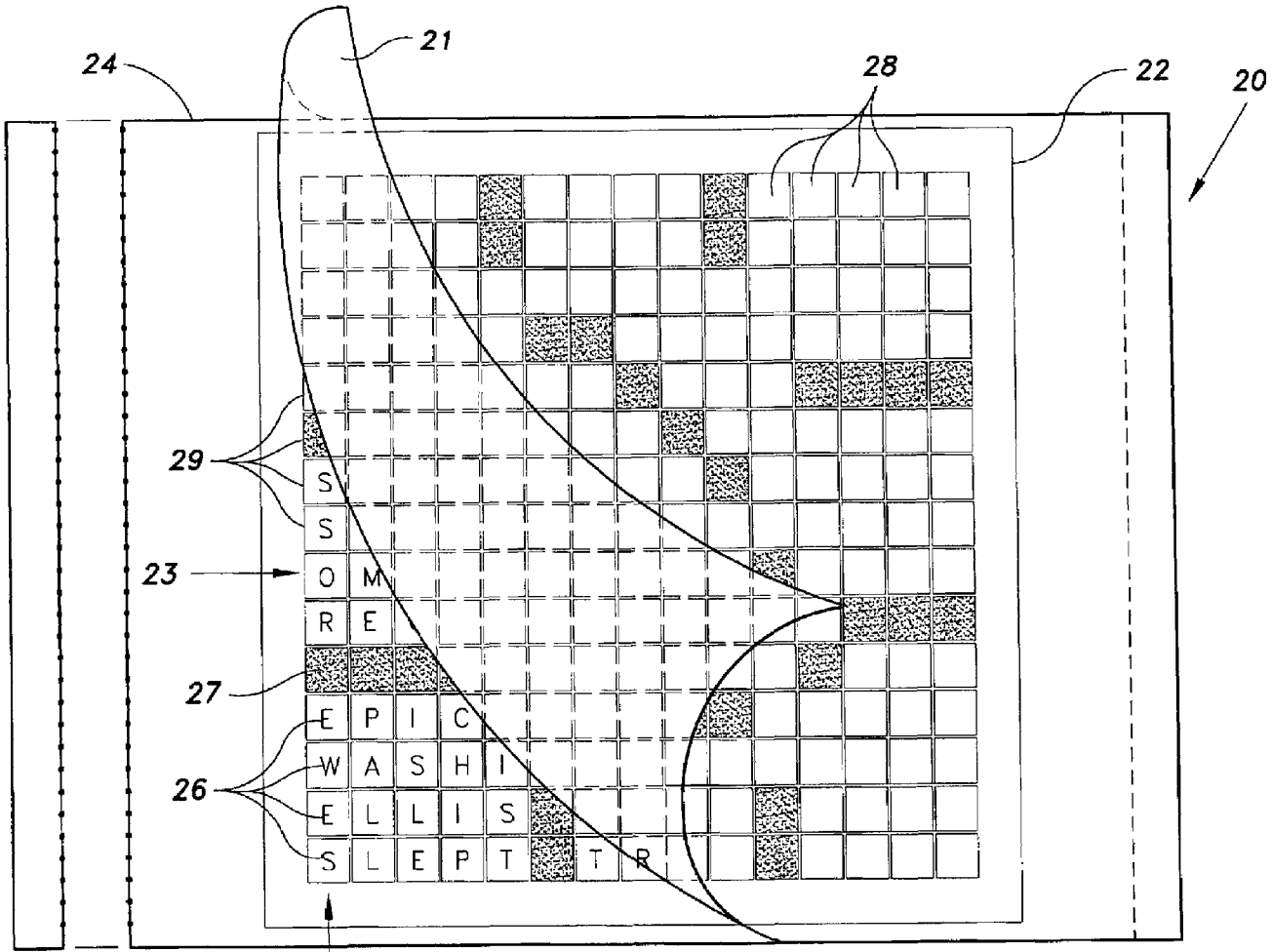
FIG. 2 is a top plan view of an exemplary solved crossword puzzle of the present game, and its removable concealing sheet.
Figure 5:
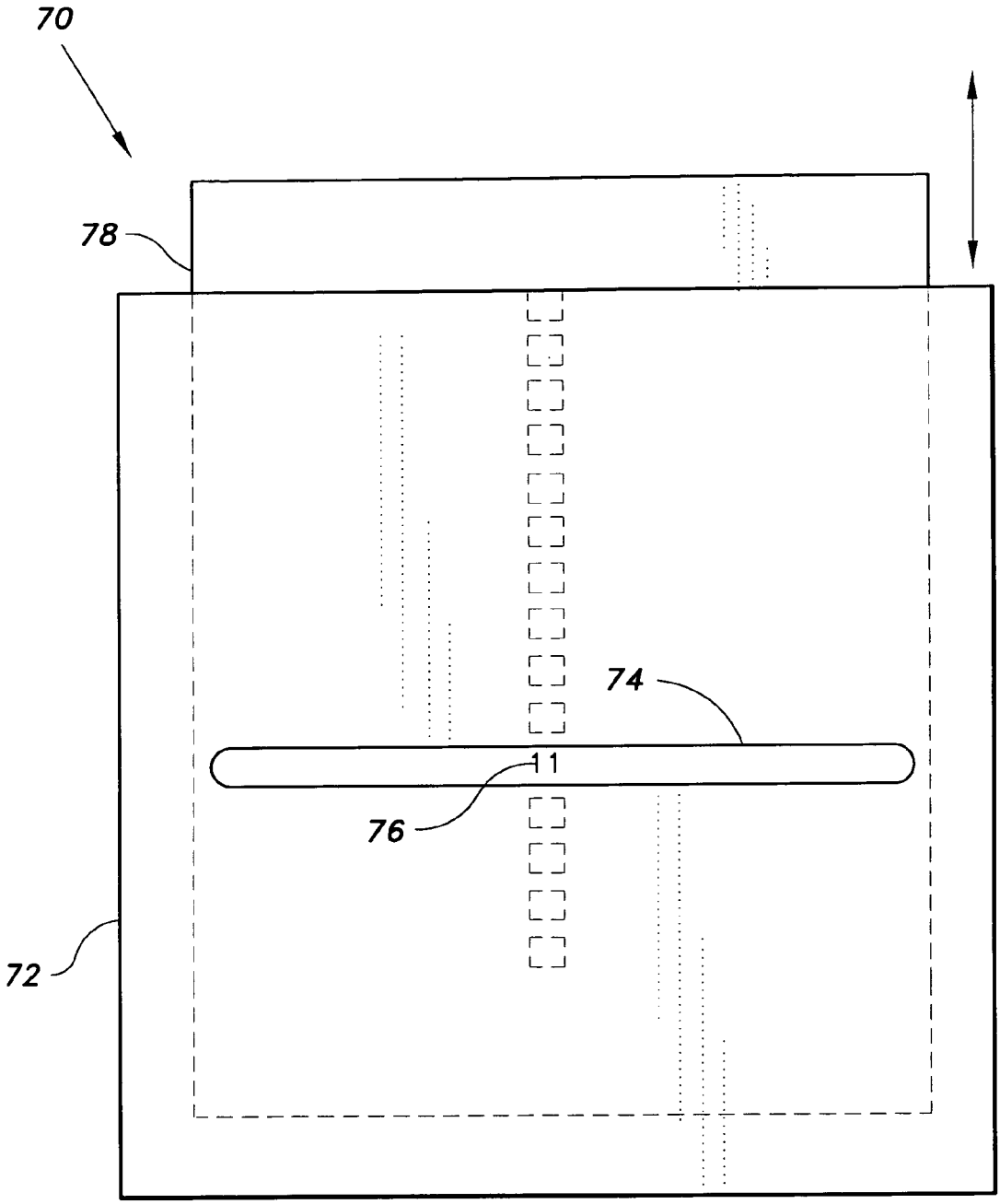
FIG. 5 is a front view of a concealing sleeve and clue sheet according to the present invention.
Figure 6:
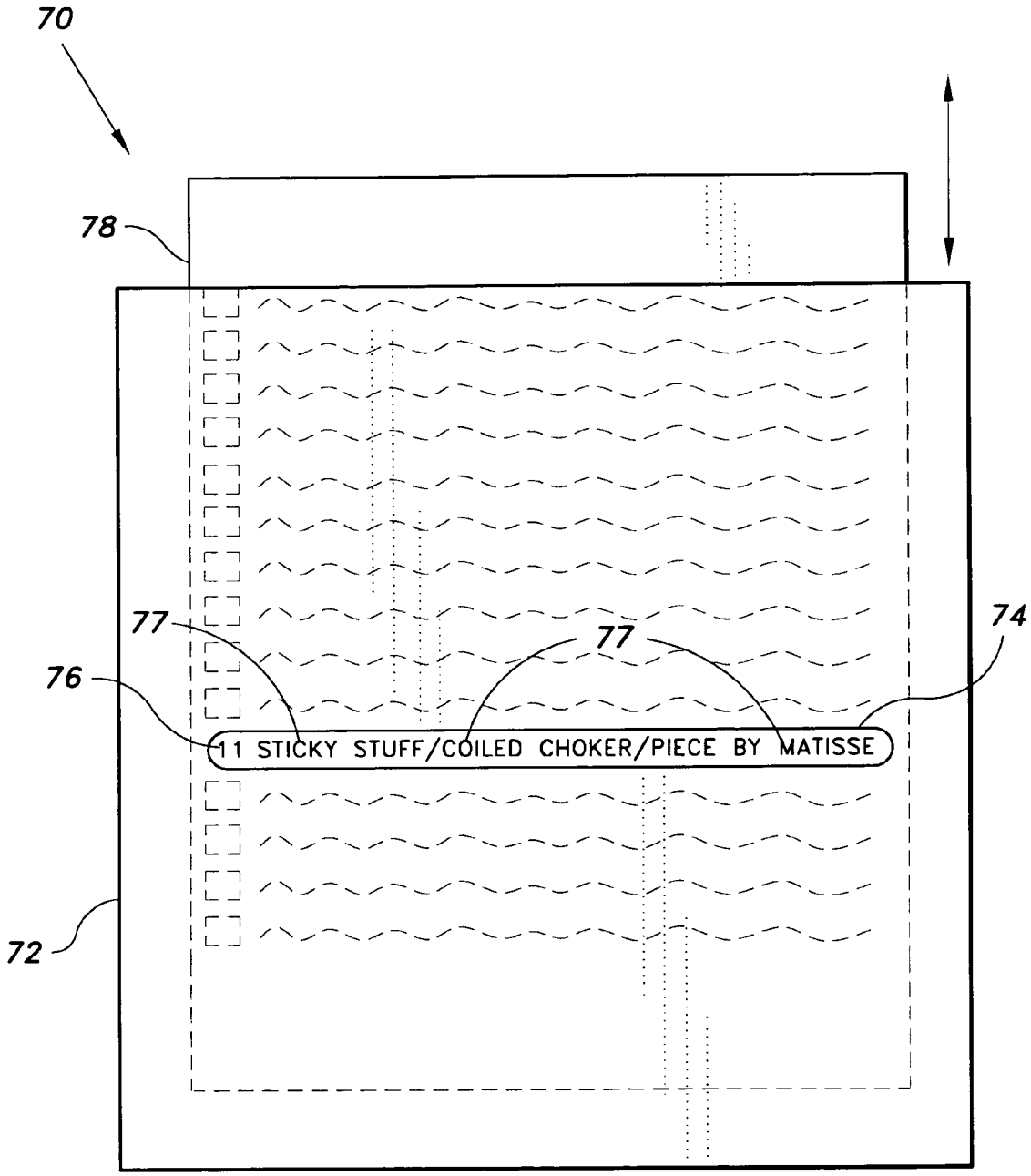
FIG. 6 is a rear view of the concealing sleeve and clue sheet of FIG. 5.
Figure 7:
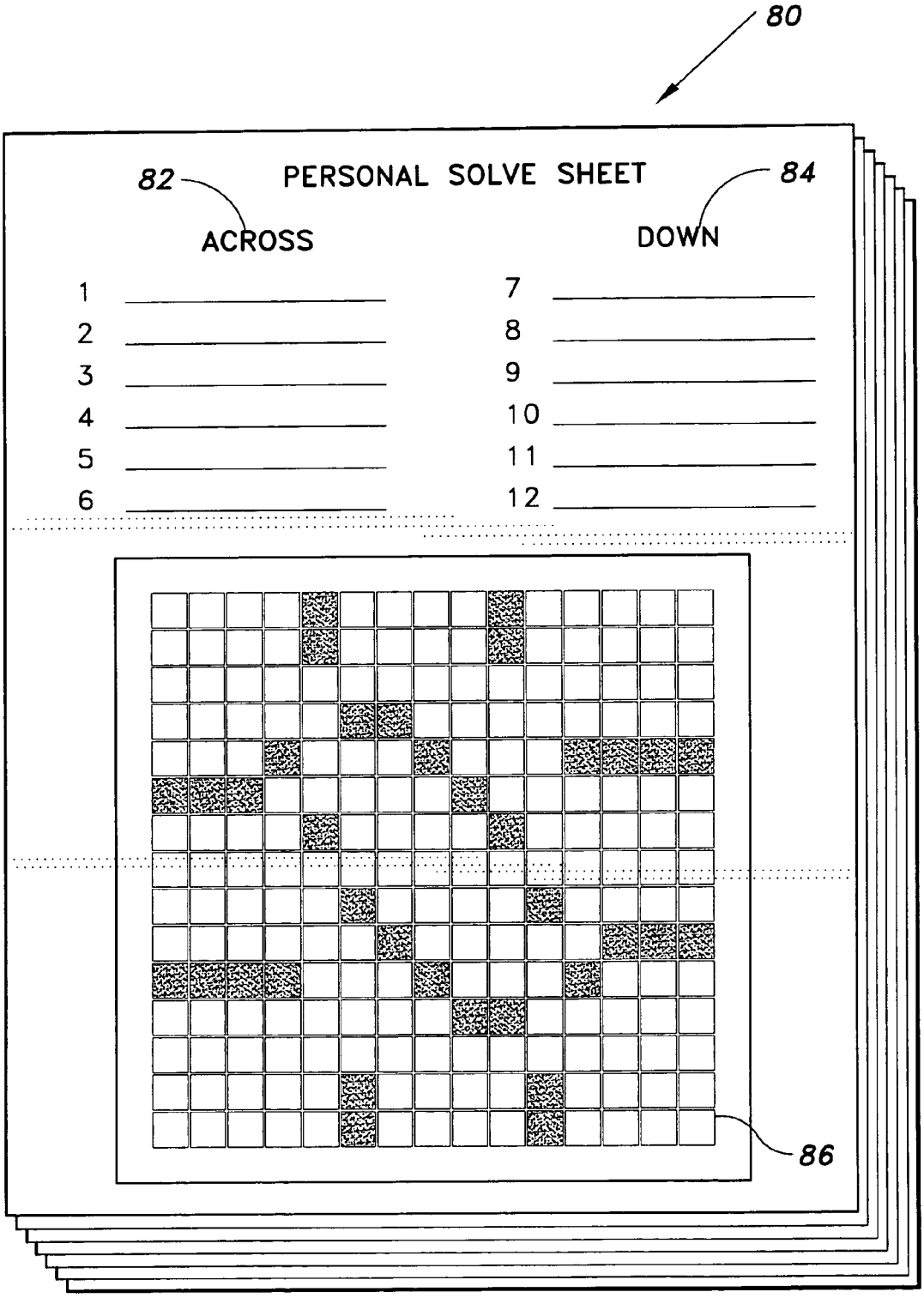
FIG. 7 is a top plan view of a personal worksheet for the game of the present invention.

Referring to FIGS. 1-7, the present invention comprises a crossword puzzle board game apparatus 50, which, in a preferred embodiment, includes at least one game board frame 10, at least one solved crossword puzzle 20, markers 16, a specially configured cubical row or column selection die 30, a plurality of row and column determination cards 40, clue and answer sheets and concealing sleeve 70, and personal worksheets 80. The game board frame 10 has a transparent or translucent top wall and a bottom wall that are joined together to form a central cavity. The central cavity of the game board 10 has an opening defined by a slot 12 through which access is gained into the cavity. The top wall of the game board 10 has a grid 18 superimposed thereover. The grid 18 is created by a plurality of rows 13 intersecting a plurality of columns 15. Raised walls 14 define each of the rows 13 and the columns 15 to create individual positions 19 on the grid 18. The number of rows 13 preferably equals the number of columns 15, but the rows and columns may differ in number from one another, depending upon the puzzle configuration. In the example of FIGS. 1, 2, and 7, the grid 18 has fifteen rows 13 and fifteen columns 15 creating a matrix of two hundred twenty-five individual positions 19.

The slot 12 of the game board 10 is dimensioned and configured to receive a solved crossword puzzle sheet 20. The puzzle 20 comprises a crossword puzzle grid pattern 24 and an opaque cover sheet 21, shown more clearly in FIG. 2 of the drawings. The crossword puzzle grid pattern 24 is defined by a plurality of numbered rows 23 and a plurality of numbered columns 25. The number of rows 23 and the number of columns 25 correspond to the number of rows and columns of the puzzle game board 10, e.g., fifteen by fifteen positions. In this example, the rows 23 and columns 25 intersect each other to create two hundred twenty-five individual puzzle pattern positions 29. The individual puzzle letter pattern positions 29 of the crossword puzzle grid pattern 24 display single letter indicia 26 which form a word answer for one clue on the puzzle 20 when combined consecutively along a row or column, or a black marked position 27.

The cover sheet 21 is an opaque sheet that is removably detachable from the crossword grid pattern 24. A blank crossword puzzle grid pattern 22 is displayed on an outer, top surface of the cover sheet 21. The blank crossword puzzle grid pattern 22 corresponds to, and is aligned with, the crossword puzzle grid pattern 24 disposed below which includes indicia 26, 27. However, each letter indicia 26 of the crossword puzzle grid pattern 24 is concealed under a blank position 28 on the blank crossword puzzle grid pattern 22 which overlies the solved puzzle sheet 20 as it is installed within the game board 10.

As noted further above, the puzzle 20 is inserted within the cavity of the game board 10 via the slot 12 whereby the individual puzzle pattern positions 29 of the puzzle 20 align with the individual spaces 19 on the grid 18. Next, concealing or covering markers 16 are disposed on the game board 20 to conceal each blank position 28 on the blank crossword puzzle grid pattern 22. The purpose of having the blank crossword puzzle grid pattern 22 on the cover sheet 21 is to indicate where the markers 16 should be positioned in order to conceal the letter indicia 26 on the crossword puzzle grid pattern 24.

The cover markers 16 are opaque, unmarked tiles. There may be about two hundred twenty-five markers 16 for the game apparatus 50, for a fifteen by fifteen position matrix. However, not all markers 16 will be used since the markers 16 are not needed to cover the black marked indicia 27 positions. The tile markers 16 are dimensioned and configured to fit within each individual space 19 on the grid 18 between the raised walls 14 of the rows 13 and columns 15. Once the grid 18 is filled with the white tile markers 16, the cover sheet 21 on the puzzle 20 may be detached so that only the tile markers 16 will conceal the letter indicia 26 on the crossword puzzle grid pattern 24. The markers are retained in position atop the lettered game sheet positions 26 by the row and column walls 14 of the game board 10, as the opaque cover sheet 21 is pulled from the puzzle receptacle within the game board.

Referring now to FIGS. 5 and 6, the clues 70 comprise an across (row) and a down (column) clue sheet 78 having a front side and a back side. Both the down and the across clue sheet have the same structures and differ only in their crossword clues and assigned orientation (horizontal row or vertical column), and can be discussed generally to describe the clues 70. The front side of the clue sheet 78 (FIG. 5) displays row or column numbers 76 one through fifteen (depending upon whether the clue sheet 78 is for the row or column clues) and are listed in a column down the center of the clue sheet 78. The back side of the clue sheet 78 (shown in FIG. 6) displays the same set of numbers 76, one through fifteen (for a fifteen by fifteen matrix puzzle), and are listed down in a column with the clue problems 77 being displayed next to each number 76. The numbers 76 displayed on the front side of the clue sheet 78 are aligned with the clue problems 77 displayed on the back side of the clue sheet 78. The line numbers 76 correspond to the number of rows and columns displayed on the puzzle 20; therefore, if the puzzle 20 had more or fewer than fifteen lines, the line numbers 76 would be modified to reflect that. The number of clue problems 77 displayed next to each line number 76 corresponds to the number of answered clues displayed on the puzzle 20. For example, line eleven across of puzzle 20 (see the corresponding personal worksheet 80 of FIG. 7, for a clear view of line eleven) has three clue answers; therefore, the clue sheet 78 for line eleven across would display three clue problems 77, as shown in FIG. 6.

The clue sheet 78 is disposed within a sleeve 72. The sleeve 72 has a front wall joined along its sides to a back wall, thereby having an open top edge and an open bottom edge. The front wall and the back wall of the sleeve 72 are joined to define a central cavity in which the clue sheet 78 is placed and manipulated during the game. A window 74 is formed through each panel of the sleeve 72. The windows 74 are central longitudinal, horizontal slits through which the line numbers 76 from the front side of the clue sheet 78 and the clue problems 77 disposed on the rear side of the clue sheet 78 are selectively displayed, based on directions received from the cards 40 and the die 30.

Figure 3:
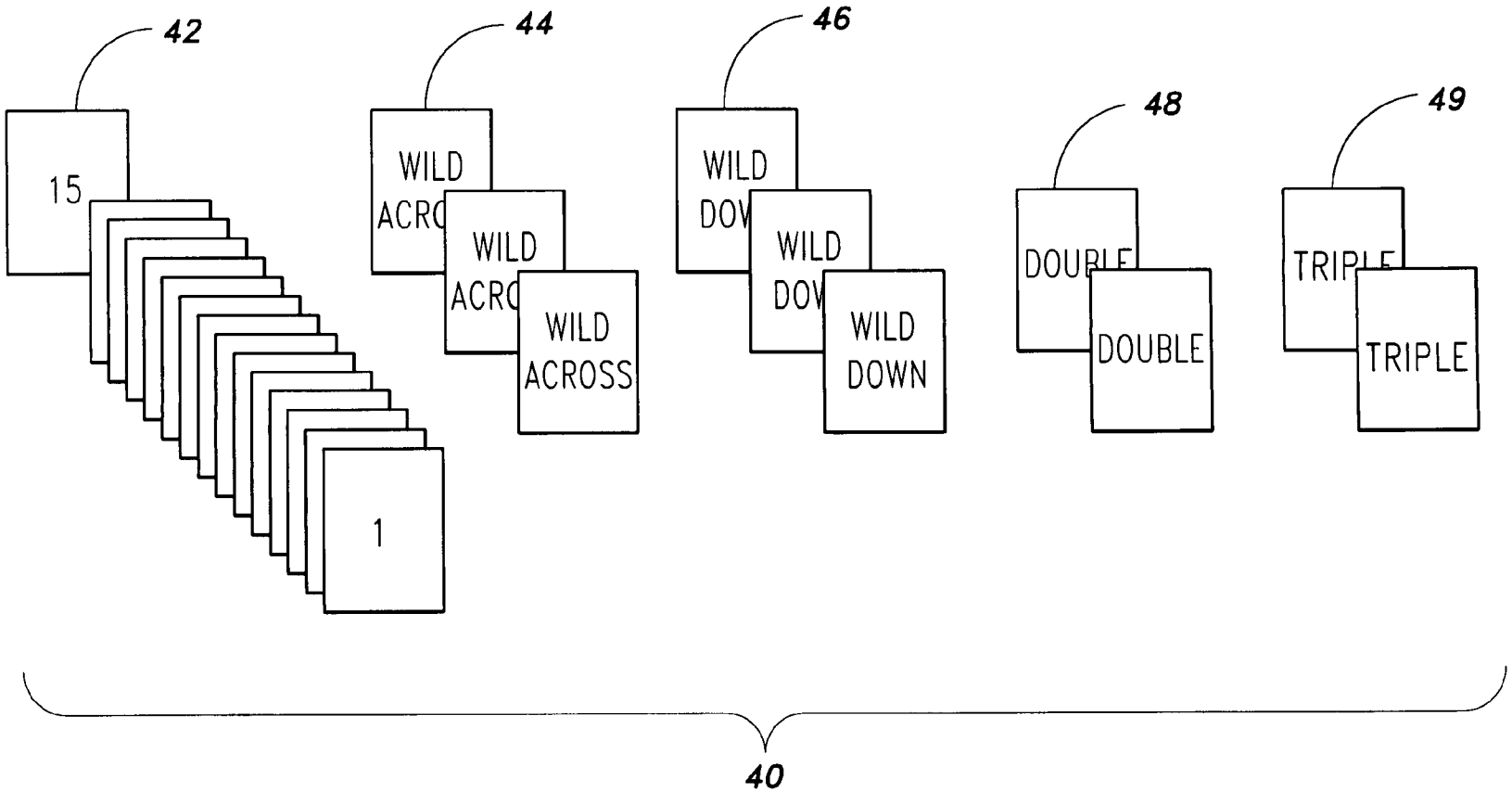
FIG. 3 is a top plan view of a plurality of different types of instruction cards used in the game of the present invention.

Once the game board 10 and clue sheet 78 are set up, the game is ready to be played using the clues 70, the cards 40 and the die 30. Clues 77 are selectively revealed to players based on drawing one of the row and column selection cards 40 and rolling the die 30. The cards 40 are separated into three general groups, as shown in FIG. 3. The first group of cards comprises numbered row and column determination cards 42 each displaying a single number from one to the maximum number of rows and/or columns in the puzzle; these numbers correspond to the number of rows and columns displayed on the game sheet 20, clue sheets 70, and personal worksheets 80. If the puzzle had more or fewer than fifteen lines, then the numbered cards would be adjusted to reflect that number. Players draw these numbered cards 42 in turn to determine the specific row or column to be played during their turn.

The second group of cards comprises a series of wild cards 44, 46 that allow the player to choose any row or column desired, according to the wild card drawn. These wild cards comprise one or more "WILD ACROSS" cards 44 and one or more "WILD DOWN" cards 46. The "WILD ACROSS" card 44 directs the player to choose any numbered horizontal row from which a clue problem can be revealed, while the "WILD DOWN" card 46 directs the player to choose any numbered vertical column from which a clue problem can be revealed. These wild cards 44 and 46 are shuffled randomly with the numbered cards 42, with the drawing of one of the wild cards 44 or 46 precluding the drawing of a numbered card 42 during that turn.

The third group of cards 48, 49 allows the player to increase the value of his or her score. These cards comprise "DOUBLE" 48 and "TRIPLE" 49 wild cards. These variable value cards 48, 49 allow the player to double or triple, respectively, points awarded for solving the clue problem.

Figure 4:
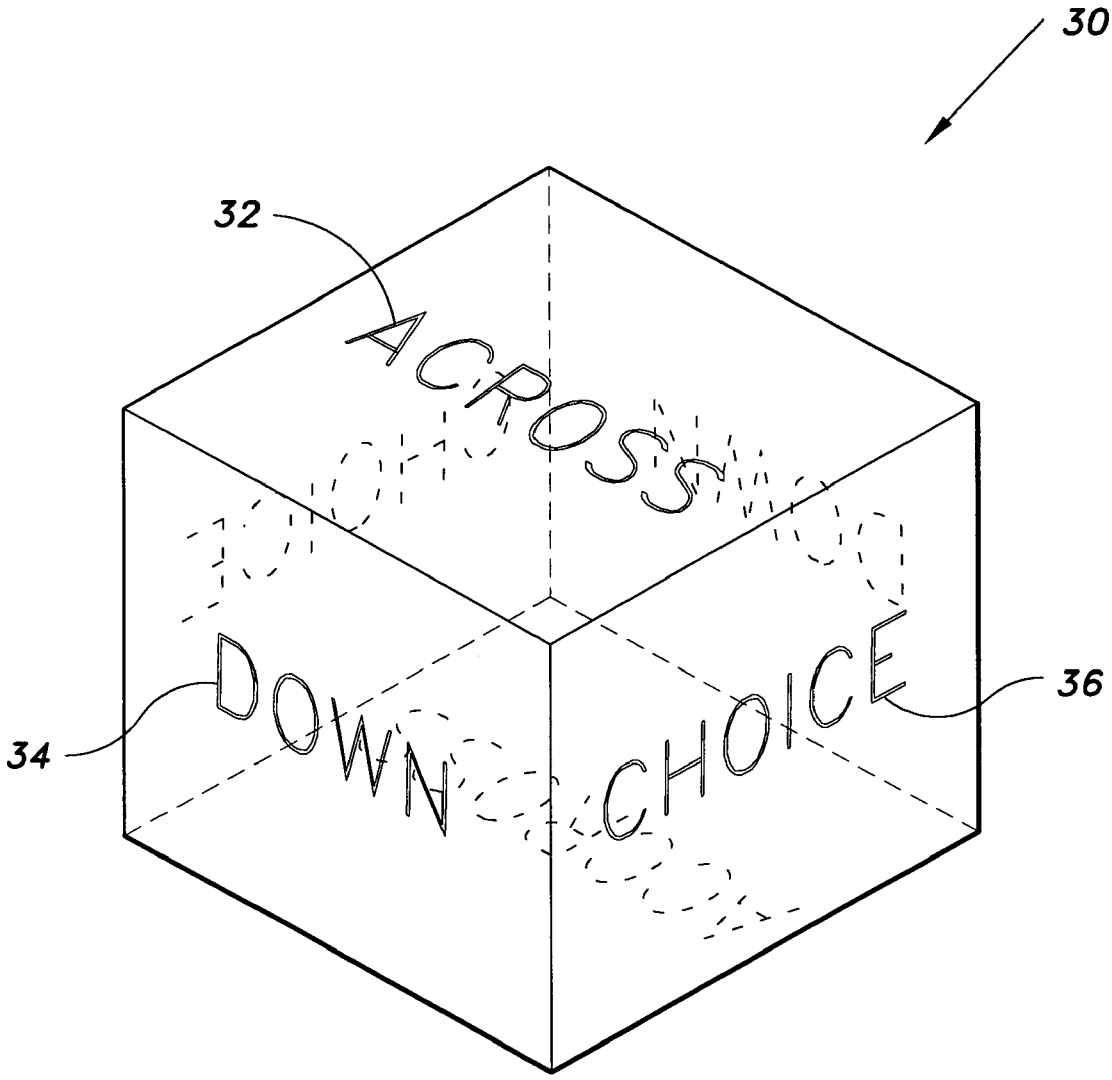
FIG. 4 is a perspective view of a specially marked cubical die used in the game of the present invention.

As shown in FIG. 4, the die 30 is generally cubical, displaying indicia "ACROSS" 32, "DOWN" 34, and "CHOICE" 36 on a plurality of faces. The single die 30 is mainly used in conjunction with the numbered cards 42 to determine the direction of play once the numbered card 42 reveals the number of the row or the column to be played. The "CHOICE" 36 face of the die 30 allows the player to decide whether the direction of play will be down or across after the numbered card 42 is chosen.

The object of the game is to acquire the highest score possible by solving as many of the words of the puzzle board 20 for the maximum number of points possible. Points are generally only awarded when the answer to the clue is spelled correctly. Points are allocated to the clue answers based on the number of clue answers disposed in one row or column and the order in which the clue answer is revealed on the grid 18 , regardless of the clue answer's location within the row or column and degree of difficulty in solving the clue answer.

Rows or columns having one clue answer may be allotted thirty points. Rows or columns having two clue answers may be allotted ten points for the first solved clue answer and twenty points for the second solved clue answer. Rows or columns containing three or more clue answers may be allotted points in increments of five points. For instance, in the three or more word row or column, the first solved clue answer is awarded five points, the second solved clue answer is awarded ten, the third solved clue answer is awarded fifteen points, etc. The above-described point system is exemplary, and other point values and systems may be provided as desired.

Bonus points may be allotted for a single clue problem 77 having a multiple word clue answer. The multiple word clue answer receives e.g., five points for each word in the answer. For example, if one clue answer is "gotothebank" twenty points may be awarded for a four-word answer, each word receiving five points for a total of twenty points. If the one multiple word clue answer, "gotothebank", is the only clue answer in one row or column then thirty points is added to the twenty bonus points, giving the player who correctly solved the clue answer a total of fifty points. The player will also receive points for all complete clue answer words formed in other lines as a result of entering one correct clue answer. Points may be doubled or tripled if the player who solved the multiple word clue answer had drawn a variable value card 48, 49 prior to solving the clue answer.

Points are deducted for incorrect responses in the same manner as cited above, with the exception of values allotted from the variable value cards 48, 49. The deduction will be in the same amount of the regular line value, not the multiplied value. If other crossing clue answer words are formed while incorrectly answering one clue answer, the incorrectly answered crossing clue answer word will be deducted.

General rules permit each player to solve only one clue problem 77 during one play turn, even if the player knows more than one, or all, clue answers. The clue answers to the clue problems 77 only receive points if spelled correctly. Point values are determined as described above and in accordance with the drawing of any variable value cards 48, 49. In a failed attempt to solve the clue problem 77 a player may use a "SNEAK A PEEK" provision where that player, alone, may look under a marker 16 and make a personal record of it on his or her solve or worksheet 80.

Play begins by determining the order of play among the players. This may be determined by drawing from the various cards 42 through 49, with the order of play being determined by the numerical ranking of the numbered cards 42 drawn by the players in either low to high or high to low order, as desired. Other means for determining order of play may be used, as desired.

Once the game apparatus 50 is set up by placing the puzzle 20 in the game board frame 10 and positioning the white tile markers 16 over the letter indicia 26 and the order of play is determined, the game will proceed in a predetermined pattern to allow all players to play in sequential turn, e.g., to the left in a clockwise direction. At the start of the game, the first player draws one card from the plurality of cards 40 to determine which row or column of clue problems 77 should be read. The die 30 may be rolled to determine whether an across (row) or down (column) of clue problems 77 should be read if the card 40 drawn is one of the number indicia cards 42. For instance, if the card 40 drawn displays the number fourteen, then the player must roll the die 30 to determine whether the direction of play is across, down or player's choice between the two directions.

If, however, the first player draws the "WILD ACROSS" card 44 from the group of variable location cards 44, 46, then the player would not have to roll the die 30, since the player is permitted to choose which of the fifteen rows from which he/she would like to read the clue problems 77. The same procedure would apply if the variable location cards 44, 46 drawn were the "WILD DOWN" card 46.

If, instead, the player draws one of the variable value cards 48, 49, the player would have to continue to draw cards 40 until one of the numbered indicia cards 42 or a variable location card 44, 46 is attained, whereby clue problems 77 from a row or column line number 76 can be read from the clues 70. Again, if the card drawn is one of the numbered indicia cards 42, then the die 30 must be rolled to specify the across, down, or player's choice direction. In situations where more than one of the variable value cards 48, 49 is drawn during one turn, i.e., when drawing two or more such variable value cards while attempting to draw a numbered card 42, only the last exposed variable value card 48, 49 will apply to increase the point value of the clue problem 77 solved.

After the location of play is determined, the player must read the clue problems 77 from the designated clues 70. Assuming the location of play is line eleven across, the player would take the across clue sheet 78 in its sleeve 72, manipulate the clue sheet 78 to expose the eleventh line number 76 through the window 74 of the sleeve 72 from the front side, then turn the sleeve 72 over to view the clue problems 77 exposed thorough the window 74 of the back wall of the sleeve 72. After the clue problems 77 are read, the player may, after taking a reasonable amount of time, attempt to solve one (and only one) clue problem 77 from the designated line of clues revealed during that particular play turn, or may pass the turn.

If the player decides to attempt to solve one of the clue problems 77, the player would have to remove the white tile markers 16 from the individual spaces 19 on the grid 18 and verify that the answer is correct to get points. As mentioned above, the player gains points for correctly spelled answers and loses points for incorrect or misspelled answers.

During play, the players answer the clue problems 77 directly on the grid 18 of the game board 10, and/or may enter notes, the clue problem 77, or answers for the clue problem 77 on the player's own personal worksheet or solve sheet 80, since all the clues from one line are revealed to the player during each play turn. The worksheets 80 each display an across answer area 82, a down answer area 84 and a blank puzzle pattern 86. The across answer area 82 and the down answer area 84 are blank and may be numbered to correspond to the number of rows and columns displayed on the puzzle 20. The blank puzzle pattern 86 is an exact duplicate of the crossword puzzle grid pattern 24. The personal solve sheets or worksheets 80 therefore provide sufficient space for players to store answers that cannot be revealed during a play turn or should not be revealed for strategic reasons.

If the player opts to pass his or her turn, the player will be able to "SNEAK A PEEK". The "SNEAK A PEEK" provision allows the player to remove the marker 16 from one individual space or position 19 anywhere on the grid 18 and look at it without disclosing the letter indicia 26 to the other players. For passing the play turn, the player will receive zero points. The "SNEAK A PEEK" provision ensures that the puzzle 20 will eventually be solved without worry of a stalemate. The player may note the letter observed by the "SNEAK A PEEK" procedure, on his or her personal worksheet 80 for future reference.

Any clues solved by a player may only be played upon the game board 20 during that player's turn, and then only after receiving that corresponding clue line directly by way of selecting one of the numbered cards 42 and rolling the die 30. If the player does not receive the corresponding clue line directly, then the player may select the clue line if he or she randomly selects one of the variable location cards 44, 46 in which case the player may select the set of clues that can be solved and play the previously determined response.

The game then continues in the same manner as described above, by each player in turn. After each round, i.e., several turns of play in which the deck of cards has been passed through during play, the individual cards 40 deemed unplayable (e.g., any numbered cards 42 for which the corresponding row and column have been completely filled in) are retired to a "burn pile," and the remaining cards 40 are reshuffled for the next round. One round encompasses the full deck of cards 40 being used where each used card is turned down after being used once. Unplayable cards are identified as cards that correspond to a line within which all answers for the designated line are already filled.

The scores for the game are kept on a separate score sheet, which may be any suitable piece of paper or other writing or recording means. Once all the clue problems 77 are solved and answered, the player with the highest point count is declared the winner. As each clue answer on the grid 18 is unveiled, the white tile markers 16 removed from the individual spaces 19 can be placed aside or placed on a grid of a second game board frame that has been previously prepared to hold a new solved crossword puzzle. The markers 16 removed from the first game board 10 will be used to conceal the blank, white spaces 28 on the cover sheet of the new solved crossword puzzle. By using two game boards 10 the players would reduce the time required to set up a subsequent game board frame 10, since it is slowly being prepared during the play of the first game. The preferred game embodiment therefore can have a single game board 10 or two identical game boards 10.

The game may involve some strategic maneuvers in solving the clue problems 77. For instance, upon each turn the player generally will answer one clue problem 77 according to what is most beneficial to that player. At times, however, it may be advantageous to take fewer points in an effort to conceal key letters that may help the other players while, at the same time, recording the clue answers on the player's own personal solve sheet 80. This strategic maneuver is especially important when the potential clue answer is part of one or more crossing clue answers on the puzzle 20.

As an option, the game rules may be altered. For example, the general rule of acquiring points based on the prerequisite of correctly spelling the clue answer may be deemed inapplicable to one or more players. Also, in addition to the "SNEAK A PEEK" technique being used when one player passes a turn, the "SNEAK A PEEK" technique may be afforded to the player with the lowest score at the end of each round. Furthermore, the benefit of increasing point value based on the variable value cards 48, 49 may be refused to the player in the lead after each round.

Figure 8:
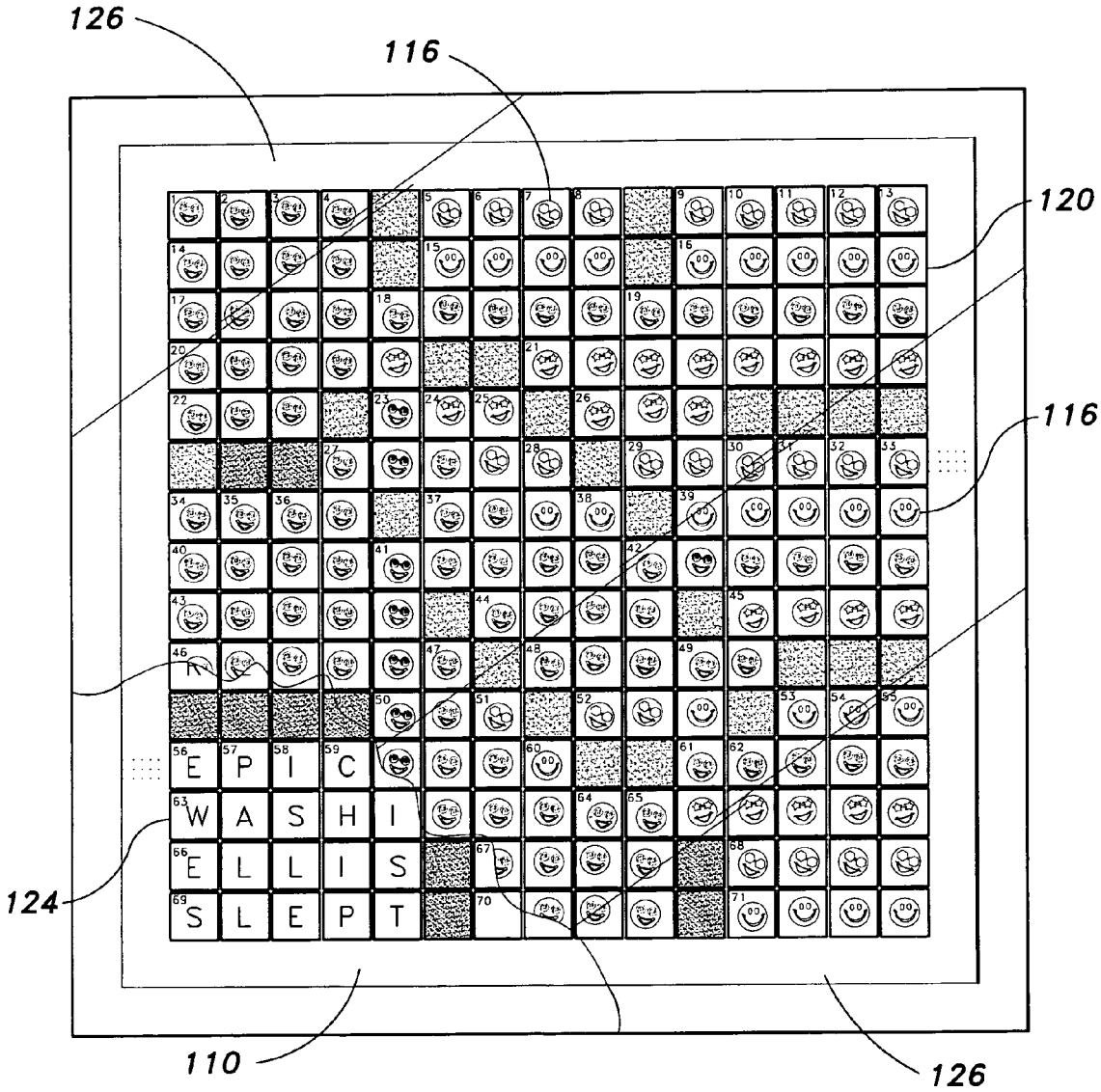
FIG. 8 is a top plan view of an alternative embodiment of a solved crossword puzzle board according to the present crossword puzzle game invention.

Referring to FIG. 8, in an alternative embodiment, game board frame 10 is not used, and instead a holding board 110 that retains a crossword puzzle sheet 120 is provided. The crossword puzzle sheet 120 has a cover sheet 126 joined directly onto the puzzle sheet 120. The cover sheet 126 is a transparent plastic sheet permanently fixed the to puzzle sheet 120. The crossword puzzle sheet 120 is a solved puzzle that has a puzzle pattern similar to the preferred embodiment, comprising a plurality of rows preferably being equal in number to a plurality of columns. The rows intersect the columns to create individual puzzle pattern spaces where each individual puzzle pattern space is concealed by a cover marker 116. Each marker 116 is a removable sticky overlay piece that is dimensioned and configured to conceal and cover clue answers disposed in each individual puzzle pattern space on the puzzle sheet 120. The puzzle sheet 120 is manufactured with the adhesive markers 116 already in place on the sheet 120, precluding the need to prepare the game apparatus 50 with the preferred embodiment. Aside from the construction of the board 110 and the puzzle 120, the rules and game play are the same as that described in the first embodiment.

The crossword puzzle 20, 120, the personal solve sheets 80, and the clue sheets 78 generally can only be used once and must be disposed of after each use. The game boards 10, 110, the die 30, the cards 40, the clue sleeves 72 and the tile markers 16 are reusable and therefore should be kept for future use. The puzzles 20, 120, the personal solve sheets 80, and the clue sheets 78 are replenished for continued use of the reusable parts of the game apparatus 50, 150.

One way of continuing to supply the disposable parts of the game would be to make and sell the disposable parts of the game in specific packets for future. For example, the disposable parts of the game, including the solved crossword puzzle 20, the clues 70 and the personal solve sheets 80, can be sold as a single puzzle packet unit categorized based on age as well as degree of difficulty. The game therefore can be useful not only as a recreational game but as well as an educational device.

FIGS. 9 through 12 illustrate various components of an additional embodiment of the present game. The game embodiment illustrated in FIGS. 1 through 12 and described below is played essentially in accordance with the rules of play described above for the game embodiments of FIGS. 1 through 8, but includes somewhat different apparatus for revealing word and letter clues used in the game.

Figure 9:
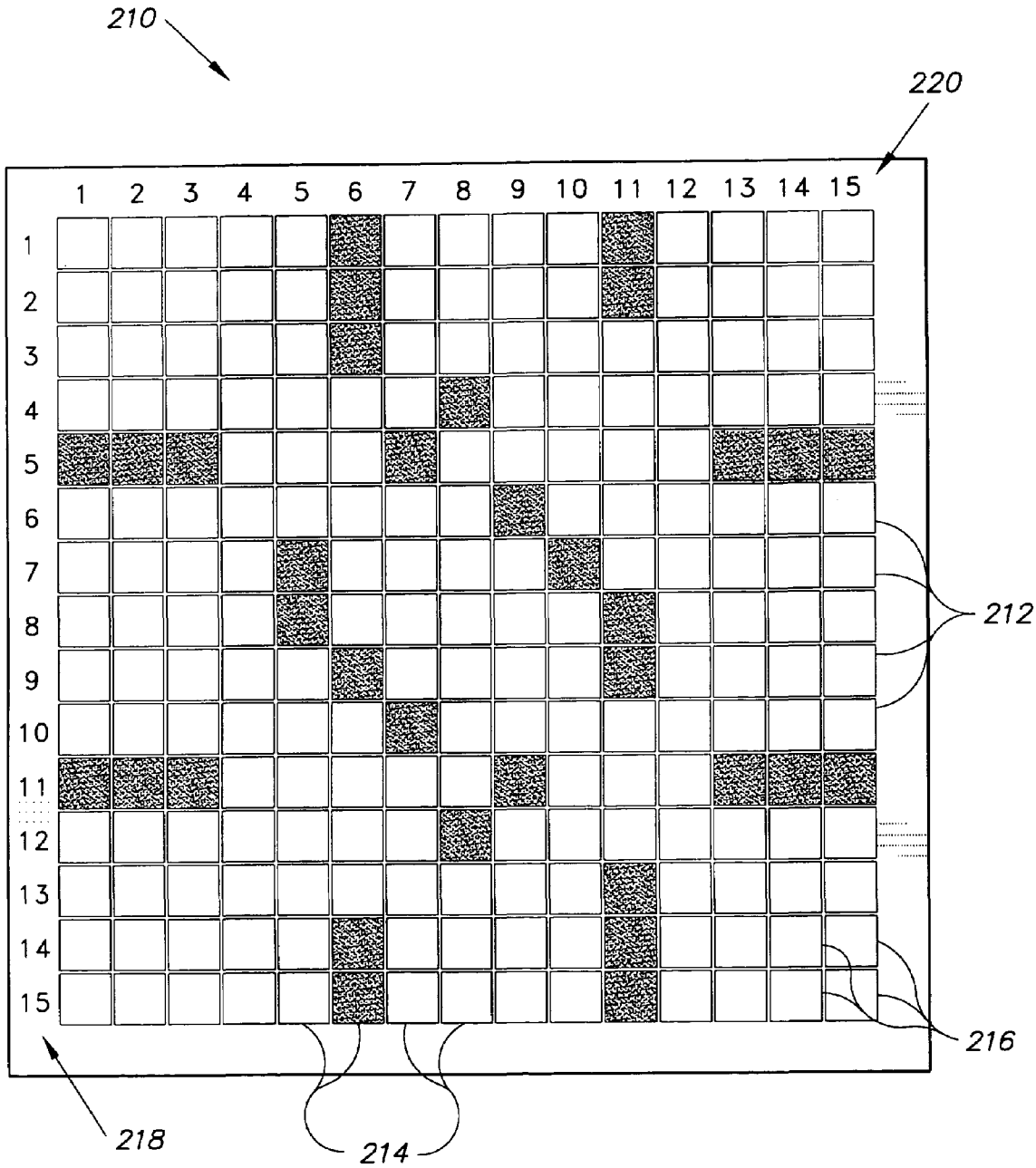
FIG. 9 is a top plan view of an exemplary crossword puzzle game board according to an alternative embodiment of the present game, showing row and column reference numbers.

FIG. 9 is a top plan view of an exemplary crossword puzzle game sheet 210 that may be used with the present game. The game sheet 210 includes a series of horizontal rows 212 and vertical columns 214 which define a matrix of positions 216 thereon. Each row 212 is identified by a number in a marginal vertical column of numbers 218, with each column 214 being identified by a number in a marginal horizontal row of numbers 220. This system is also used in the game embodiments of FIGS. 1 through 8, described further above, and is used for both the solved crossword puzzle (a single one of which is placed within a game board to conceal the letters and words until they are required to be revealed) and for the blank worksheets or solve sheets provided to each player.

Figure 10A:
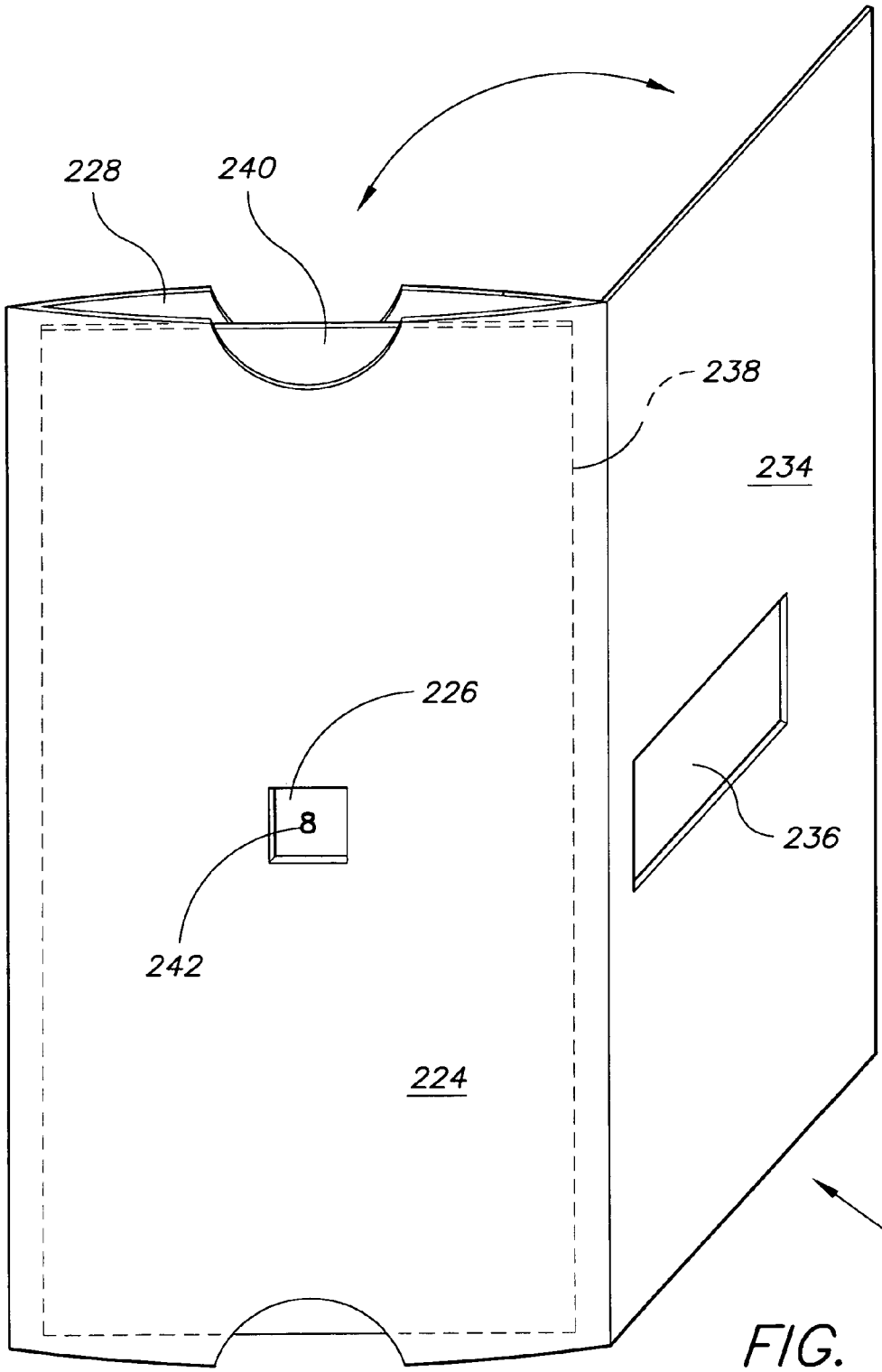
FIG. 10A is a front perspective view of an alternative embodiment of a concealing sleeve and clue sheet for the present crossword puzzle game.
Figure 10B:
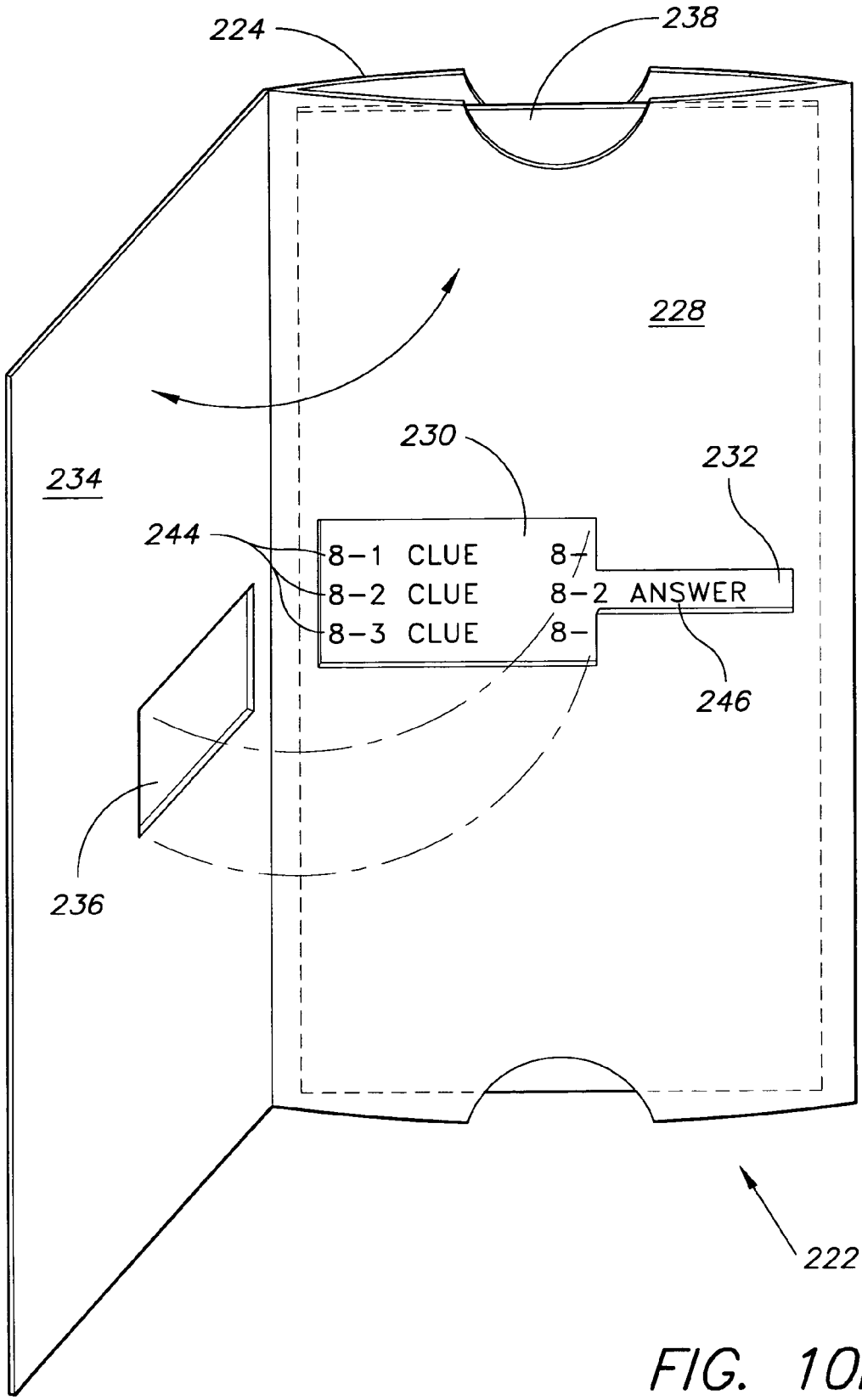
FIG. 10B is a rear perspective view of the concealing sleeve and clue sheet of FIG. 10A.

FIGS. 10A and 10B respectively illustrate the first and second sides of an alternative clue sheet holding sleeve 222 and clue sheet configuration used therewith. The sleeve 222 includes a first panel 224 having a passage or window 226 therethrough, through which one of the row or column numbers of the clue sheet may be viewed, generally like the clue sheet sleeve 72 of FIG. 5. The opposite second panel 228 includes a somewhat larger window or passage having two adjacent areas. The larger first passage area 230 is sufficiently wide as to expose each of the clues for a given row or column of puzzle clues in their entireties, with each clue perhaps comprising a definition of a few words. This larger first passage area 230 may also be formed with sufficient height as to provide for the simultaneous viewing of all of the clues in a given row or column, e.g., all three clues in a row or column of the puzzle sheet which contains three words. However, the adjacent answer portion 232 of the window or passage is relatively narrow, extending vertically only the height of one line so as to expose only a single answer. Thus, the answer sheet must be adjusted precisely within the sleeve 222 in order for a player to confirm a single specific answer, after making a play during the game.

The answer sheet sleeve 222 also includes an additional flap 234 extending from one edge of the sleeve. The flap 234 also includes a window or passage 236 therethrough, with the flap window 236 being congruent to the larger first passage area 230 of the sleeve second panel 228. The sleeve is used by folding the flap 234 over the second panel 228, with the flap window 236 aligned with the first or clue viewing portion 230 of the second panel window or passage but concealing the smaller answer portion 232 of the second sleeve passage. When a play is made, the player may raise the flap 234 to reveal the smaller answer portion 232 of the second sleeve window, thereby checking and/or verifying his or her response to the clue used during the play.

Figure 11A:
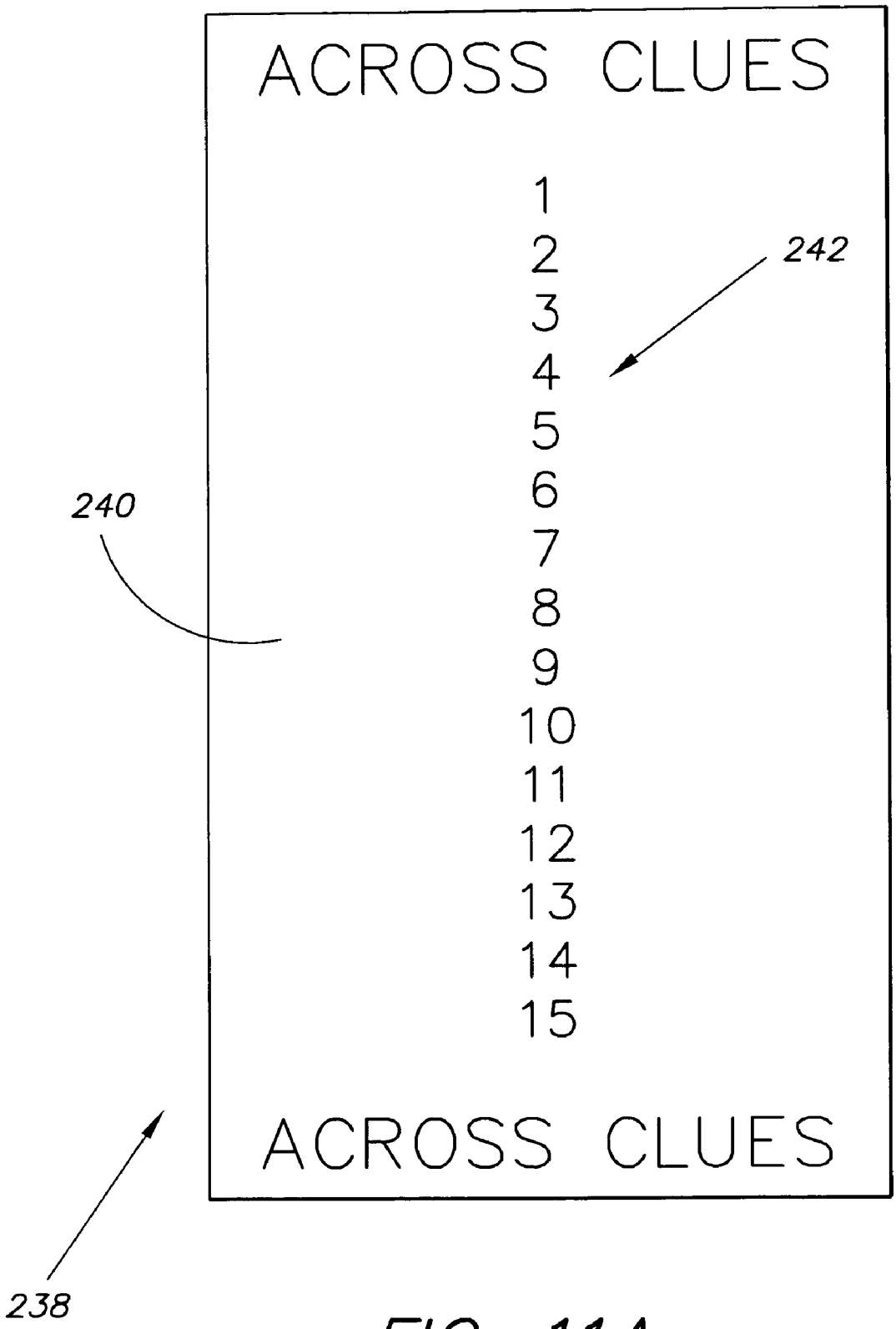
FIG. 11A is a top plan view of an exemplary row or across clue sheet for use with the sleeve of FIGS. 10A and 10B.
Figure 11B:
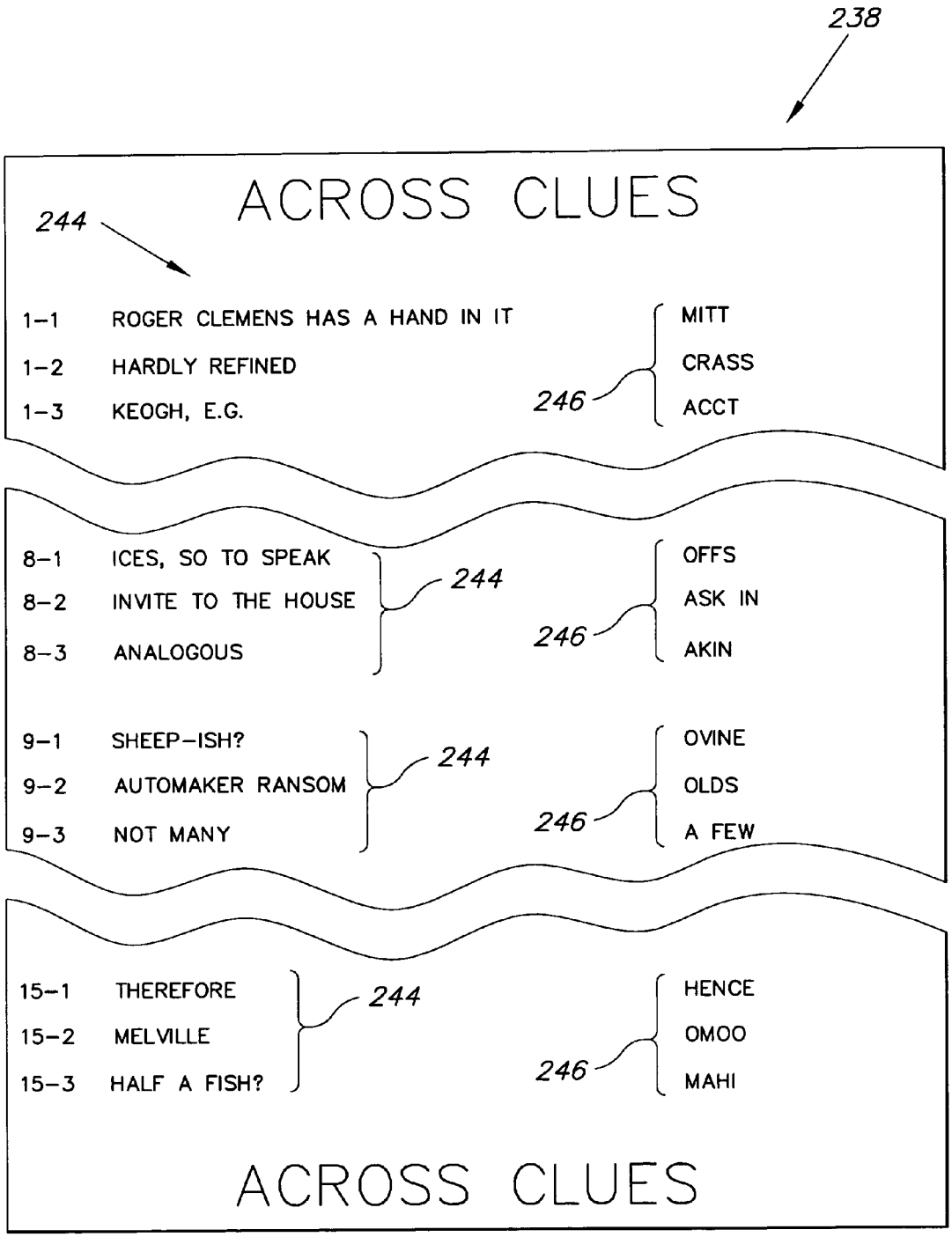
FIG. 11B is a top plan view of the back of the clue sheet of FIG. 11A, showing the clues and answers thereon.

FIGS. 11A and 11B illustrate the opposite first and second sides or surfaces of an exemplary clue sheet 238 for use with the sleeve 222. The clue sheet 238 is similar to the clue sheet 78 of FIGS. 5 and 6, having a first surface or side 240 with a series of row or column numbers 242 thereon, e.g., the row or column number "8" exposed through the first surface window 226, indicating that the clue sheet 238 is aligned within the sleeve so as to expose the word clues through the opposite larger window 230 of the sleeve second panel 228 (shown in FIG. 10B). A series of three word clues 244, i.e., clues 8-1 through 8-3, are thus exposed through the window portion 230 of the sleeve second panel, with the answer corresponding with the specific clue of the row or column number 242 being concealed by the closed flap 234 until the play is made. Once the player feels that he or she has determined the proper word for the selected clue, the flap 234 is opened to expose the smaller second or answer portion 232 of the second panel window and the answer word 246 therebeneath, thereby verifying or correcting the player's answer.

The clue sleeve 222 and its answer sheet 238 of FIGS. 10A and 10B are exemplary, and may be configured differently if so desired. The "stacking" of the series of clues for a single line of the puzzle serves to reduce the overall width of the sleeve and its answer sheet, while increasing the height of the assembly. This arrangement also has the advantage of revealing only the single answer corresponding to the single clue selected, rather than revealing all answers along a single line if all clues are placed in a single line of text. However, the sleeve and answer sheet may be made wider to place all clues for a given row or column line along a single line of text on the answer sheet, if so desired.

Figure 12:
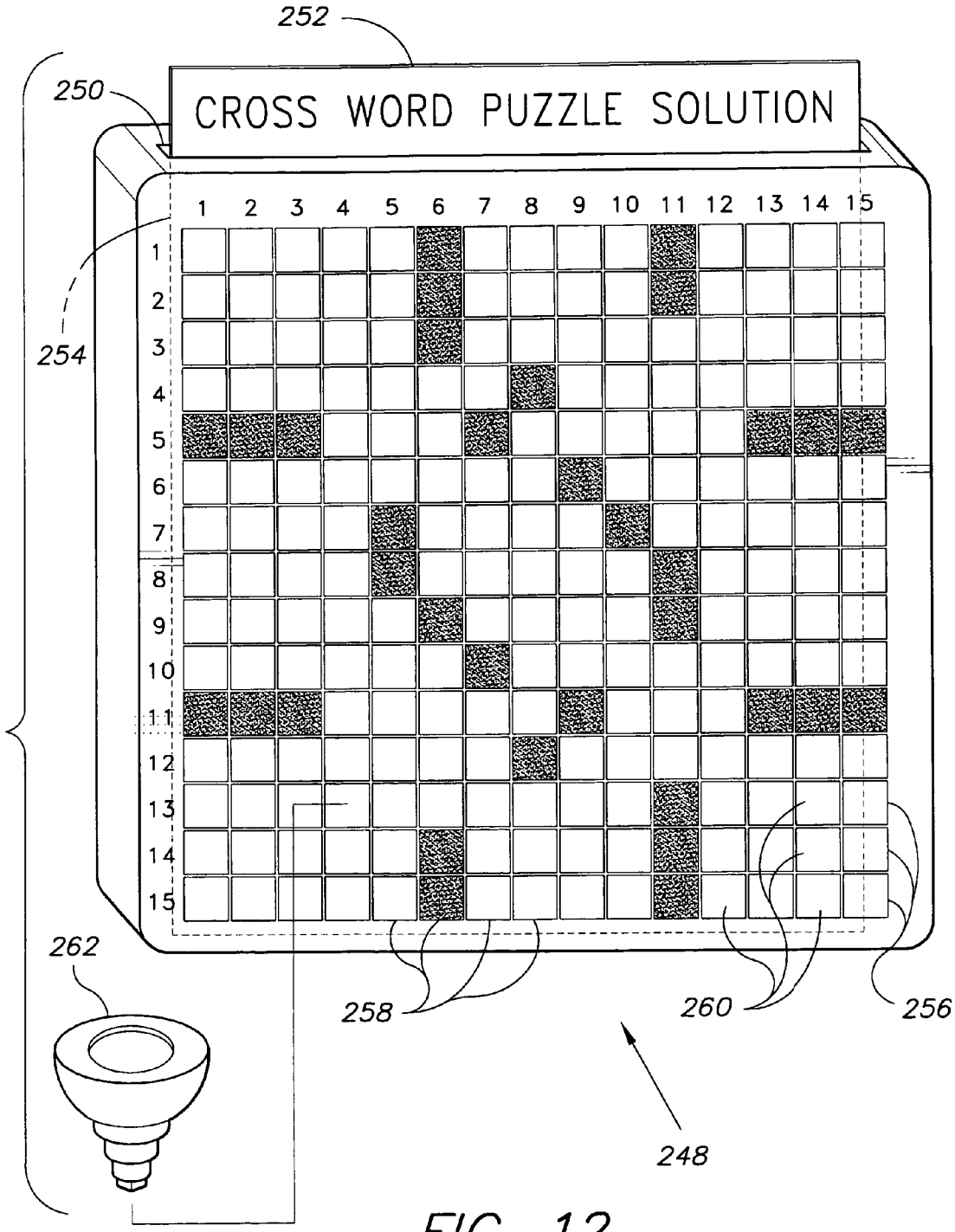
FIG. 12 is a perspective view of an alternative embodiment of a crossword puzzle solution viewer, including an optically obscured puzzle holder and optical viewing device for viewing letters through the optical obscuration.

FIG. 12 is an illustration of an alternative puzzle board 248 which may be used with the present competitive crossword puzzle solving game. The puzzle board 248 is a flat, generally closed unit having a slot 250 along one edge thereof for the removable insertion of a solved crossword puzzle sheet 252 into the puzzle sheet receptacle 254 within the board 248, generally along the lines of the puzzle board 10 shown in FIG. 1 and described further above. The board 248 is divided into a series of horizontal rows 256 and vertical columns 258 which define a matrix of positions 260, similarly to the puzzle game board 10 of FIG. 1. However, the board 248 embodiment of FIG. 12 is opaque to the naked eye, rather than being transparent or translucent as in the gridded playing surface of the board 10. Thus, players cannot view the completed puzzle of the puzzle solution sheet 252 when it is installed within the game board 248.

A specialized viewing device 262 is provided for players to view individual letters of the puzzle solution sheet 252 through the otherwise opaque surface of the game board 248. The viewer 262 is placed atop the selected one of the letter positions 260 on the board 248, and enables the player to view the selected letter on the puzzle solution sheet 252 through the otherwise opaque surface of the board 248. The material of the normally opaque board surface, and the viewer enabling the player to see through the board surface, are conventional articles provided by e.g., Rehtmeyer, Inc. of Aurora, Ill.

Figure 13:
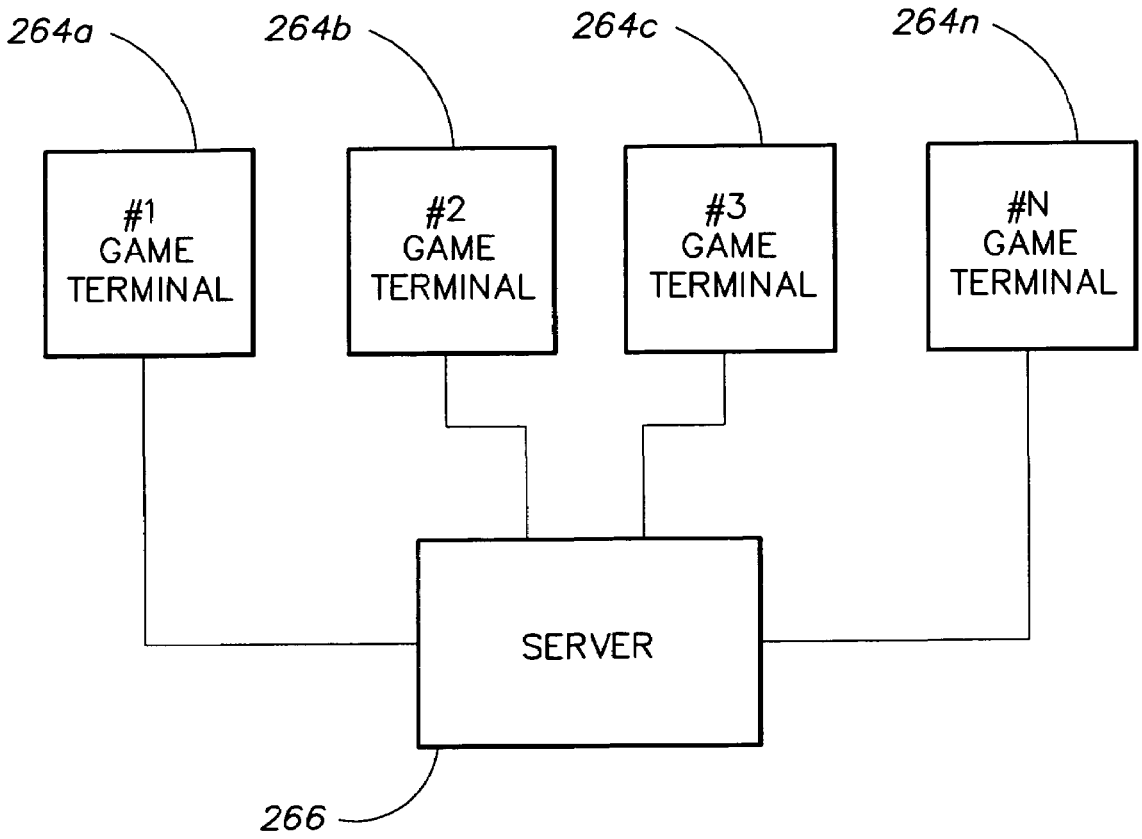
FIG. 13 is a schematic diagram showing the interrelationship of components for electronic play of the present game.

The game may be played as an electronic version as well, if so desired. FIG. 13 provides a basic schematic illustration of such an electronic game system, comprising a series of game terminals 264*a*, 264*b*, 264*c* . . . 264*n*, each of which communicates electronically through and with a central server 266. One or more players may operate each game terminal 264*a* through 264*n*, with the terminals taking the place of the physical game board 10 or 248 and its corresponding solved puzzle sheet 20 or 252 and the cards 40, die 30, and worksheets 80 used with all other game embodiments. Scoring, record keeping, determination of correct or incorrect responses, etc., is accomplished by the central server 266 using a program provided for the system.

Figure 14:
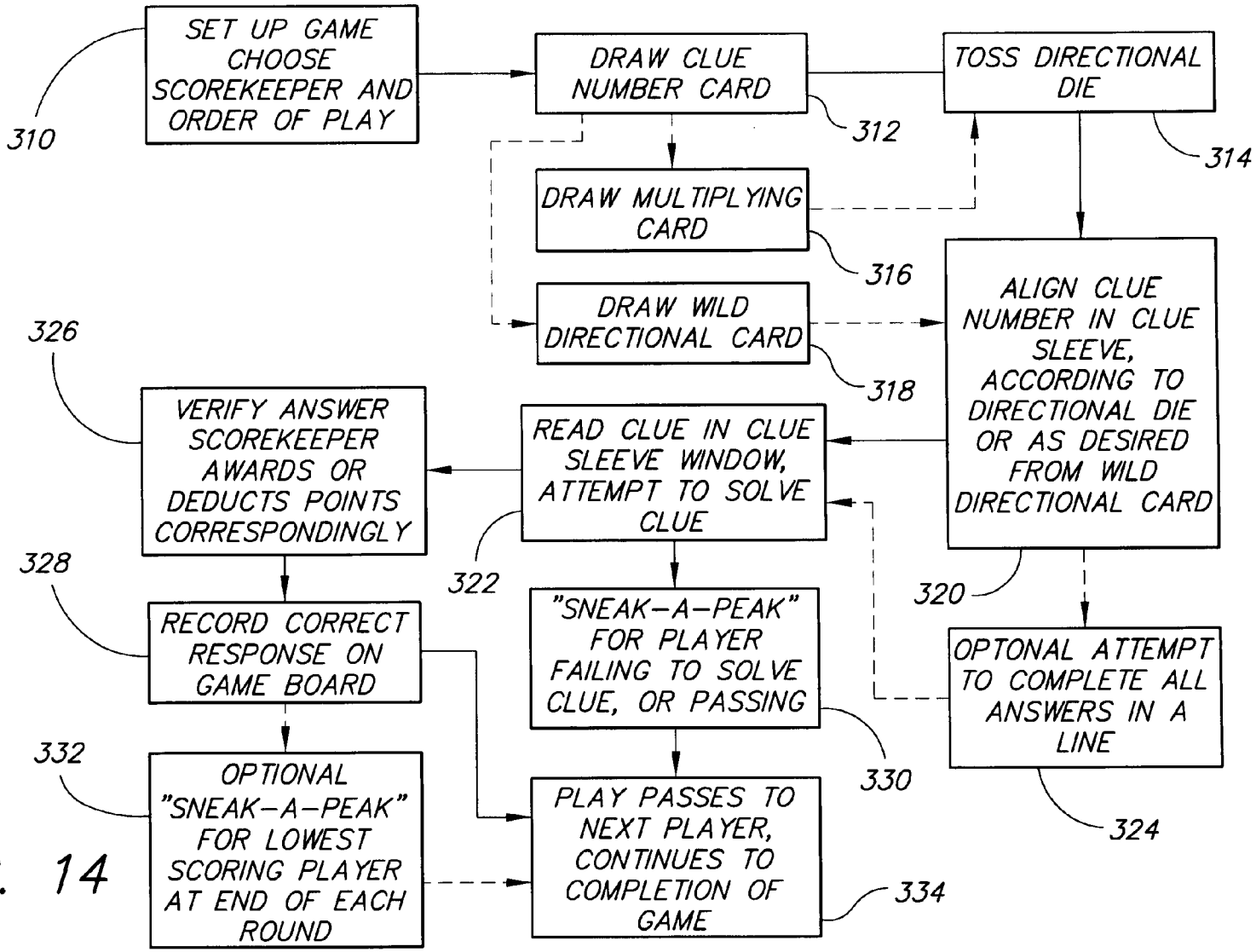
FIG. 14 is a flowchart describing the basic steps in the method of play of the game.

FIG. 14 provides a flow chart illustrating the basic steps in the method of play of the present game. All embodiments of the present crossword puzzle game, whether using physical gaming apparatus or electronic play, utilize essentially the same method and procedure outlined in FIG. 14. Initially, the game must be set up, a scorekeeper selected, and the order of play among the players determined, as indicated by the initial step 310 of FIG. 14. Play begins with the first player drawing one of the cards 40 in order to determine the number of the row or column to be played, as indicated by the second step 312 of FIG. 14. Assuming the player draws one of the numbered cards 42, he or she then tosses the directional die 30 to determine whether the selected number will apply to a row or a column, or whether the player may choose, generally as indicated by the third step 314 of FIG. 14.

A player may randomly draw one of the word score multiplying cards 48 or 49 while attempting to draw one of the row or column number cards 42, as indicated by the optional fourth step 316 of FIG. 14. If the player draws such a multiplier card before drawing a row or column number card, the player draws again until drawing a number card, with the last drawn multiplier card being used as the multiplier for the word score achieved by that player during the play. The player continues to the step of tossing the directional die to determine whether a row or column is to be played, in accordance with the third step 314 of FIG. 14.

A player may instead randomly draw one of the wild directional cards 44 or 46 while attempting to draw a row or column number card, as indicated by the optional fifth step 318 of FIG. 14. Assuming such a directional card is drawn, the player must still draw a number card 42 to determine the number of the row or column to be used. However, the player drawing a directional card need not toss the die, as it is up to the player to determine whether he or she wishes to play along a row or column in this circumstance. Accordingly, play progresses to the sixth step 320, wherein the clue number on the clue sheet is aligned in the viewing window of the sleeve and the clue(s) are read through the window on the reverse side of the clue sleeve. Once the player reads the clues, he or she may determine which of the clues he or she wishes to answer (where multiple words are provided along a single row or column) and attempt to answer the clue with the proper word, generally as indicated by the seventh step 322 of the flow chart of FIG. 14. Optionally, a player may attempt to complete all words in a multiple word line for a higher score, as indicated by the optional eighth step 324.

Once the player has provided an answer(s) to the clue(s), the scorekeeper (or player) must verify the answer by manipulating the puzzle board or clue sheet sleeve (depending upon the embodiment) in order to view the answer(s). If the player has provided a correct response, then that player is awarded points according to the value of the word(s) and any multiplier factor provided by any multiplier card that may have been drawn. This is indicated generally by the ninth step 326 in FIG. 14. The correct response(s) is/are recorded on the game board, as indicated by the tenth step 328.

In the event that the player is unable to provide a correct response (either by providing an incorrect response, or by passing his or her turn), that player is allowed to "sneak a peek" at any letter on the board which he or she selects, in accordance with the eleventh step 330 of FIG. 14. This may be accomplished in various ways depending upon the embodiment of the game being played, e.g., momentarily lifting a tile from the playing matrix of the game board 10 of FIG. 1 or an adhesive cover from the game board 110 of FIG. 8, or using the viewer 262 to view a position on the board 248 as shown in FIG. 12. Optionally, the lowest ranking player at the end of each round of play may be provided with this "sneak a peak" provision, as indicated by the optional twelfth step 332 of FIG. 14.

Play continues in the above manner with subsequent players taking their turns sequentially, as indicated by the final step 334 in the flow chart of FIG. 14. This procedure continues until all of the positions on the game board have been filled in, i.e., assigned letters to complete the puzzle, with all players receiving points in accordance with the scoring system described further above. The scores are totaled at the end of the game, with the highest scoring player being declared the winner of the game.

In conclusion, the present competitive crossword puzzle game in its various embodiments provides interesting and educational entertainment for two or more people who enjoy word games and the like. The numerous embodiments provide a number of different devices that may be used for play of the present game, including electronic play. A number of different rules are also available for play wherein the various puzzle clues are concealed from the players until verification is required after a play. Alternatively, players may be assigned opposing directions of play (horizontal rows v. vertical columns) and provided with all clues at the initiation of the game, if so desired. Regardless of the specific rules and method of play, the present game provides entertaining competition for all those involved.

It is to be understood that the present invention is not limited to the embodiments described above, but encompasses any and all embodiments within the scope of the following claims.

I claim:

1. A competitive crossword puzzle game, comprising:

a crossword puzzle game board;

a solved crossword puzzle disposed with said game board, said solved crossword puzzle having a matrix of completed letter positions thereon, the matrix of completed letter positions forming a plurality of intersecting words;

solved crossword puzzle concealing means disposed with said game board for selectively concealing said solved crossword puzzle;

a plurality of row and column determination cards;

a row clue sheet, containing row clues thereon;

a column clue sheet, containing colunm clues thereon;

a row clue sheet sleeve enclosing said row clue sheet, selectively concealing the row clues of said row clue sheet; and a column clue sheet sleeve enclosing said column clue sheet, selectively concealing the colunm clues of said column clue sheet.

2. The competitive crossword puzzle game according to claim 1, further including solved crossword puzzle clue revealing means for selectively revealing at least one of the completed letter positions of said concealed solved crossword puzzle.

3. The competitive crossword puzzle game according to claim 2, wherein said solved crossword puzzle clue revealing means comprises an opaque cover removably disposed over each of the concealed completed letter positions.

4. The competitive crossword puzzle game according to claim 2, wherein said solved crossword puzzle clue revealing means comprises:

an optically opaque cover disposed over said solved crossword puzzle; and an optical viewer, optically penetrating said optically opaque cover of said solved crossword puzzle when selectively placed thereon.

5. The competitive crossword puzzle game according to claim 1, further including a cubical die having two row selection faces, two column selection faces, and two player's choice faces.

6. The competitive crossword puzzle game according to claim 1, further including:

a front panel having a plurality of clue line numbers, disposed upon each said clue sheet;

a rear panel having a plurality of puzzle clues and answers, disposed upon each said clue sheet;

a front panel having a clue line number viewing window therethrough, disposed upon each said clue sheet sleeve; and a rear panel having a puzzle clue viewing window therethrough, disposed upon each said clue sheet sleeve.

7. The competitive crossword puzzle game according to claim 6, wherein:

the puzzle clue viewing window of each said clue sheet sleeve further includes a flap attachment edge and an answer viewing window extension;

a selectively closable flap extends from the flap attachment edge of each said clue sheet sleeve; and each said flap further includes a puzzle clue viewing window therethrough, with the puzzle clue viewing window of each said flap being congruent with the puzzle clue viewing window of the corresponding clue sheet sleeve and covering the answer viewing window of said clue sheet sleeve when folded thereover.

8. A method of playing a competitive crossword puzzle game using the apparatus of claim 1, comprising the steps of:

(a) randomly drawing a row and column number determination card;

(b) determining the row or column direction of play;

(c) revealing at least one puzzle clue corresponding to the selected row or column;

(d) responding to the at least one revealed puzzle clue;

(e) awarding a predetermined number of points to the player successfully answering the at least one revealed puzzle clue;

(f) continuing with steps (a) through (e) in sequence for each subsequent player; and (g completing the puzzle and determining a winning player according to the points awarded to each player during the game.

9. A competitive crossword puzzle game, comprising:

a crossword puzzle game board having a matrix of letter positions thereon;

a solved crossword puzzle disposed with said game board, said solved puzzle having a matrix of concealed completed letter positions thereon, the matrix of concealed completed letter positions forming a plurality of intersecting words;

a plurality of row and column determination cards;

a row clue and answer sheet, containing row clues and answers thereon;

a column clue and answer sheet, containing column clues and answers thereon;

a row answer sheet sleeve enclosing said row clue and answer sheet, selectively concealing the row clues and answers of said row clue and answer sheet;

a column answer sheet sleeve enclosing said column clue and answer sheet, selectively concealing the column clues and answers of said column clue and answer sheet; and solved crossword puzzle clue revealing means for selectively revealing at least one of the concealed completed letter positions of said solved crossword puzzle.

10. The competitive crossword puzzle game according to claim 9, wherein said solved crossword puzzle clue revealing means comprises an opaque cover removably disposed over each of the concealed completed letter positions.

11. The competitive crossword puzzle game according to claim 9, wherein said solved crossword puzzle clue revealing means comprises:

an optically opaque cover disposed over said solved crossword puzzle; and an optical viewer, optically penetrating said optically opaque cover of said solved crossword puzzle when selectively placed thereon.

12. The competitive crossword puzzle game according to claim 9, further including a cubical die having two row selection faces, two column selection faces, and two player's choice faces.

13. The competitive crossword puzzle game according to claim 9, further including:

a front panel having a plurality of clue line numbers, disposed upon each said clue sheet;

a rear panel having a plurality of puzzle clues and answers, disposed upon each said clue sheet;

a front panel having a clue line number viewing window therethrough, disposed upon each said clue sheet sleeve; and a rear panel having a puzzle clue viewing window therethrough, disposed upon each said clue sheet sleeve.

14. The competitive crossword puzzle game according to claim 13, wherein:

the puzzle clue viewing window of each said clue sheet sleeve further includes a flap attachment edge and an answer viewing window extension;

a selectively closable flap extends from the flap attachment edge of each said clue sheet sleeve; and each said flap further includes a puzzle clue viewing window therethrough, with the puzzle clue viewing window of each said flap being congruent with the puzzle clue viewing window of the corresponding clue sheet sleeve and covering the answer viewing window of said clue sheet sleeve when folded thereover.

15. A method of playing a competitive crossword puzzle game using the apparatus of claim 9, comprising the steps of:

(a) randomly drawing a row and column number determination card;

(b) determining the row or column direction of play;

(c) revealing at least one puzzle clue corresponding to the selected row or column;

(d) responding to the at least one revealed puzzle clue;

(e) awarding a predetermined number of points to the player successfully answering the at least one revealed puzzle clue;

(f) continuing with steps (a) through (e) in sequence for each subsequent player; and (g) completing the puzzle and determining a winning player according to the points awarded to each player during the game.

16. A method of playing a competitive crossword puzzle game, comprising the steps of:

(a) providing:

a crossword puzzle game board;

a solved crossword puzzle disposed with said game board, said solved crossword puzzle having a matrix of completed letter positions thereon, the matrix of completed letter positions forming a plurality of intersecting words;

a solved crossword puzzle concealing means disposed with said game board for selectively concealing said solved crossword puzzle;

a plurality of row and column determination cards;

a row clue sheet. containing row clues thereon;

a colunm clue sheet, containing column clues thereon;

a row clue sheet sleeve enclosing said row clue sheet, selectively concealing the row clues of said row clue sheet; and a colunm clue sheet sleeve enclosing said colunm clue sheet, selectively concealing the column clues of said column clue sheet;

(b) concealing a solved crossword puzzle having a plurality of letter positions forming rows and columns of words;

(c) randomly drawing a puzzle row and column number determination card;

(d) determining the row or column direction of play;

(e) revealing at least one puzzle clue corresponding to the selected row or column;

(f) responding to the at least one revealed puzzle clue;

(g) checking the response to the at least one revealed puzzle clue;

(h) awarding a predetermined number of points to the player successfully answering the at least one revealed puzzle clue;

(i) continuing with steps (b) through (h) in sequence for each subsequent player; and (i) completing the puzzle and determining a winning player according to the points awarded to each player during the game.

17. The method of playing a competitive crossword puzzle game according to the method of claim 16, wherein the step of determining the row or column direction of play comprises randomly tossing a row and column determination die.

18. The method of playing a competitive crossword puzzle game according to the method of claim 16, wherein the step of determining the row or column direction of play comprises randomly drawing a wild directional card.

19. The method of playing a competitive crossword puzzle game according to the method of claim 16, wherein the step of checking the response to the at least one revealed puzzle clue comprises revealing the area of the concealed solved crossword puzzle corresponding to the response.

20. The method of playing a competitive crossword puzzle game according to the method of claim 16, further including the step of revealing at least one of the letter positions of the solved crossword puzzle to an unsuccessful player.

* * * * *